US006638135B2

(12) United States Patent
Fong

(10) Patent No.: US 6,638,135 B2
(45) Date of Patent: Oct. 28, 2003

(54) ANIMATED DISPLAY

(76) Inventor: Peter Sui Lun Fong, 505a 5/F Empire Centre, 68 Mody Road, East Tsimshatsui Kowloon (HK)

( * ) Notice: Subject to any disclaimer, the term of this patent is extended or adjusted under 35 U.S.C. 154(b) by 0 days.

(21) Appl. No.: 09/990,235

(22) Filed: Nov. 21, 2001

(65) Prior Publication Data

US 2003/0096556 A1 May 22, 2003

(51) Int. Cl.[7] ..... A63H 1/24; A63H 1/28

(52) U.S. Cl. ..... 446/242; 446/236; 446/265; 40/430; 40/473

(58) Field of Search ..... 446/236, 239, 446/242, 265, 330, 332, 331; 40/430, 473

(56) References Cited

U.S. PATENT DOCUMENTS 1,711,790 A * 5/1929 Johnson
2,157,199 A * 5/1939 Doering
6,247,991 B1 * 6/2001 Chen ..... 40/610
6,422,915 B1 * 7/2002 Chen ..... 40/610

* cited by examiner

*Primary Examiner*—Derris H. Banks
*Assistant Examiner*—Bena B. Miller
(74) *Attorney, Agent, or Firm*—Stetina Brunda Garred & Brucker

(57) ABSTRACT

An animated display comprising a lower sleeve assembly which itself includes a lower outer sleeve and a lower inner sleeve concentrically positioned within the lower outer sleeve. Also included in the animated display is an upper sleeve assembly comprising an upper outer sleeve having an upper inner sleeve concentrically positioned therewithin. The upper sleeve assembly is selectively retractable into and extensible from the lower sleeve assembly in a telescoping fashion. The animated display further comprises an actuation assembly which is cooperatively engaged to the lower and upper sleeve assemblies. The actuation assembly is operative to facilitate the rotation of the lower inner sleeve relative to the lower outer sleeve, the rotation of the upper outer and inner sleeves relative to the lower sleeve assembly, the retraction of the upper sleeve assembly into the lower sleeve assembly, and the extension of the upper sleeve assembly from the lower sleeve assembly.

11 Claims, 29 Drawing Sheets

SECTION A–A

SECTION A–A

ANIMATED DISPLAY

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to motion toys, and more particularly to a uniquely configured, animated display, toy, lamp, or lantern comprising a series of telescoping, rotatable cylinders and a rotatable platform which are capable of concurrent linear and rotational movement relative to each other to provide a novel visual effect.

There is known in the prior art a wide range of animated seasonal toys which employ the use of motors and gear trains to accomplish various types of movements. Exemplary of such animated seasonal displays are talking Christmas trees, displays including an animated Santa Claus alone or in combination with Mrs. Claus, and Christmas trees with one or more openable and closeable doors which reveal an interior animated decorative scene when opened. Due to cost and pricing constraints, the majority of these animated seasonal toys do not include internal mechanics and drive systems which are capable of providing a highly sophisticated level of concurrent movement of various parts or components of the display in different directions and/or at different speeds. The present invention provides a uniquely configured animated display, toy, lamp, or lantern which provides these attributes via a novel mechanical construction of minimized complexity, and hence cost. Though the present invention finds specific utility in relation to a seasonal animated display, those of ordinary skill in the art will recognize that the mechanical construction as will be described in detail below is applicable to non-seasonal animated displays as well.

BRIEF SUMMARY OF THE INVENTION

In accordance with the present invention, there is provided an animated display comprising lower and upper sleeve assemblies. The lower sleeve assembly includes a lower outer sleeve having a lower inner sleeve concentrically positioned therewithin. Similarly, the upper sleeve assembly includes an upper outer sleeve having an upper inner sleeve concentrically positioned therewithin. The upper sleeve assembly is selectively retractable into and extensible from the lower sleeve assembly in a telescoping fashion. Cooperatively engaged to the lower and upper sleeve assemblies is an actuation assembly. The actuation assembly is operative to facilitate the rotation of the lower inner sleeve relative to the lower outer sleeve, the rotation of the upper outer and inner sleeves relative to the lower sleeve assembly, the retraction of the upper sleeve assembly into the lower sleeve assembly, and the extension of the upper sleeve assembly from the lower sleeve assembly. In an alternative embodiment, the actuation assembly may be operative to further facilitate the rotation of the upper inner sleeve relative to the upper outer sleeve in the same or opposite direction.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
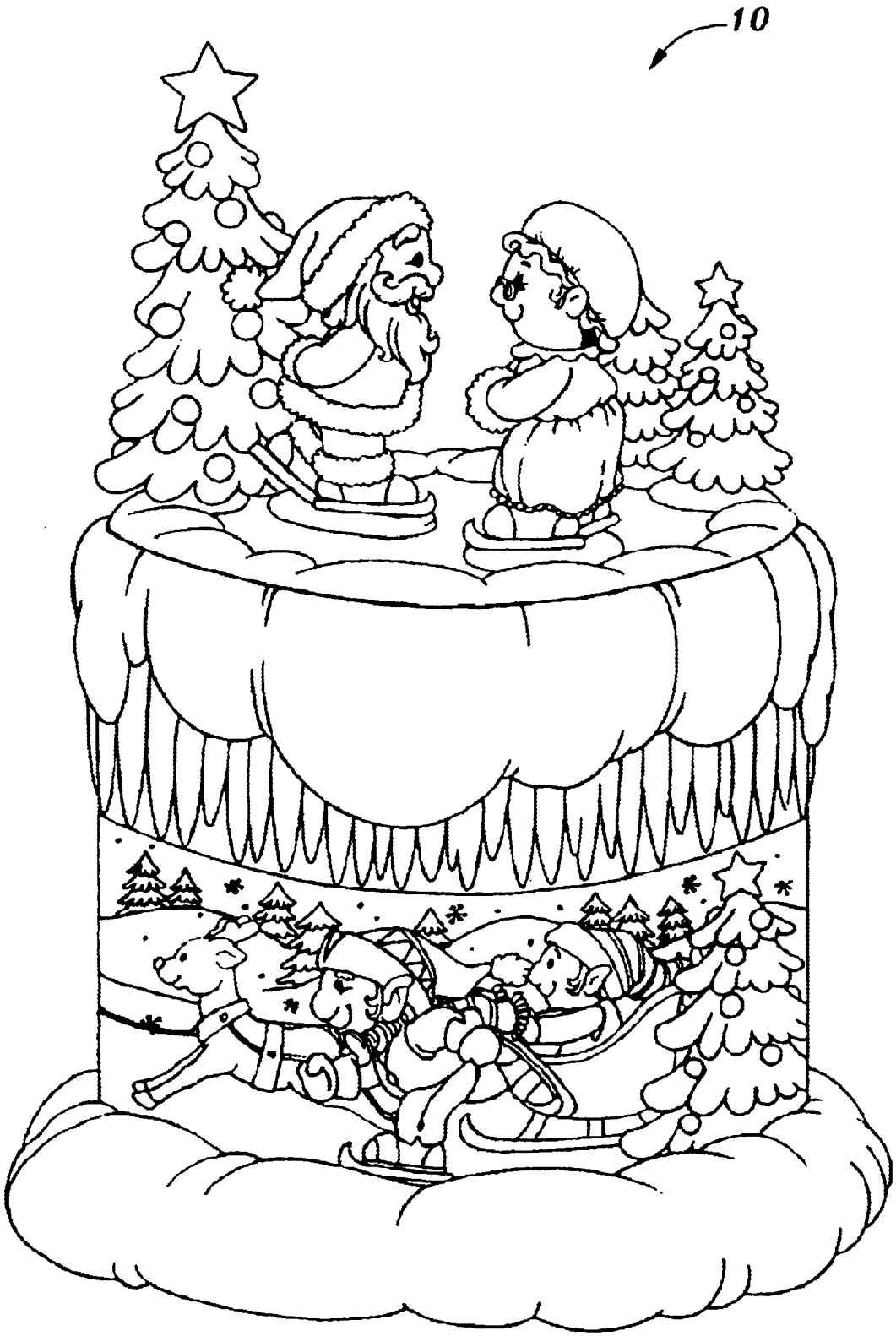
FIG. 1 is a perspective view of an animated display constructed in accordance with a first embodiment of the present invention in a retracted configuration.
Figure 2:
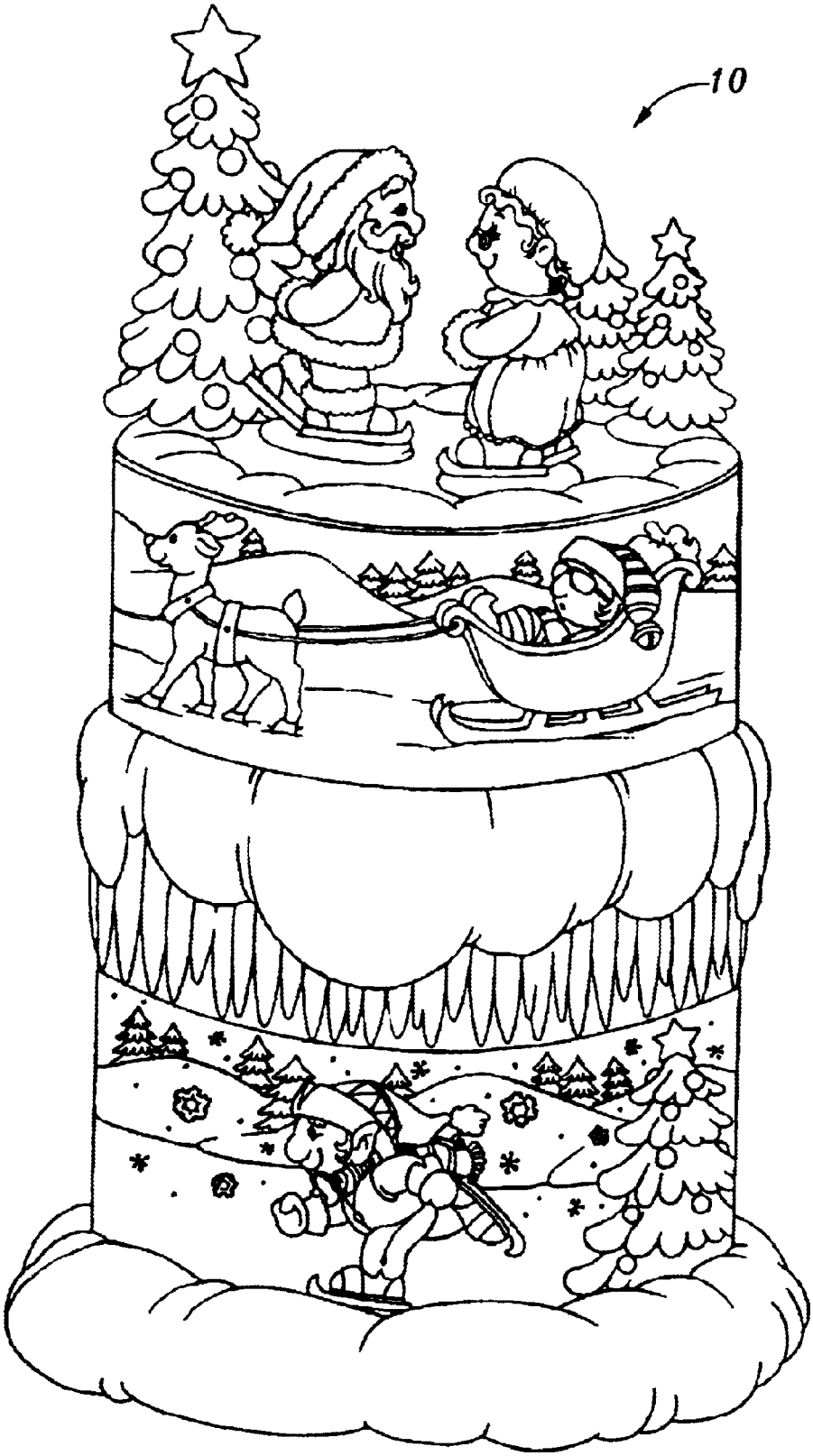
FIG. 2 is a perspective view of the animated display of the first embodiment in an extended configuration.

Referring now to the drawings wherein the showings are for purposes of illustrating preferred embodiments of the present invention only, and not for purposes of limiting the same, FIGS. 1 and 2 perspectively illustrate an animated display 10 constructed in accordance with a first embodiment of the present invention. As will be discussed in more detail below, the animated display 10 is selectively moveable between a retracted configuration (shown in FIG. 1) and an extended configuration (shown in FIG. 2). As shown in FIGS. 1 and 2, the animated display 10 has a seasonal motif (i.e., a Christmas theme). However, those of ordinary skill in the art will recognize that the present animated display 10 need not necessarily be constructed to have a seasonal theme, with the Christmas theme depicted in FIGS. 1 and 2 being for exemplary purposes only.

Referring now to FIGS. 3–6, the animated display 10 of the first embodiment comprises a lower sleeve assembly 12. The lower sleeve assembly 12 itself comprises a cylindrically configured, tubular lower outer sleeve 14 and a cylindrically configured, tubular lower inner sleeve 16. Attached to the upper end of the lower outer sleeve 14 is an enlarged, annular collar 18 of the lower sleeve assembly 12. In the animated display 10, the lower inner sleeve 16 is preferably fabricated from a translucent material, and includes decorative indicia thereon. The lower outer sleeve 14 is preferably fabricated from a transparent material itself having decorative indicia thereon. The collar 18 attached to the lower outer sleeve 14 is preferably fabricated from a translucent or opaque material, and also includes decorative indicia thereon.

In the lower sleeve assembly 12, the lower inner sleeve 16 is concentrically positioned within the lower outer sleeve 14. The lower outer and inner sleeves 14, 16 are sized relative to each other such that a narrow, annular gap of uniform width is defined between the lower outer and inner sleeves 14, 16 when the lower inner sleeve 16 is advanced into the lower outer sleeve 14. The lower inner sleeve 16 is further rotatable relative to the lower outer sleeve 14 in a manner which will be described in more detail below.

Figure 5:
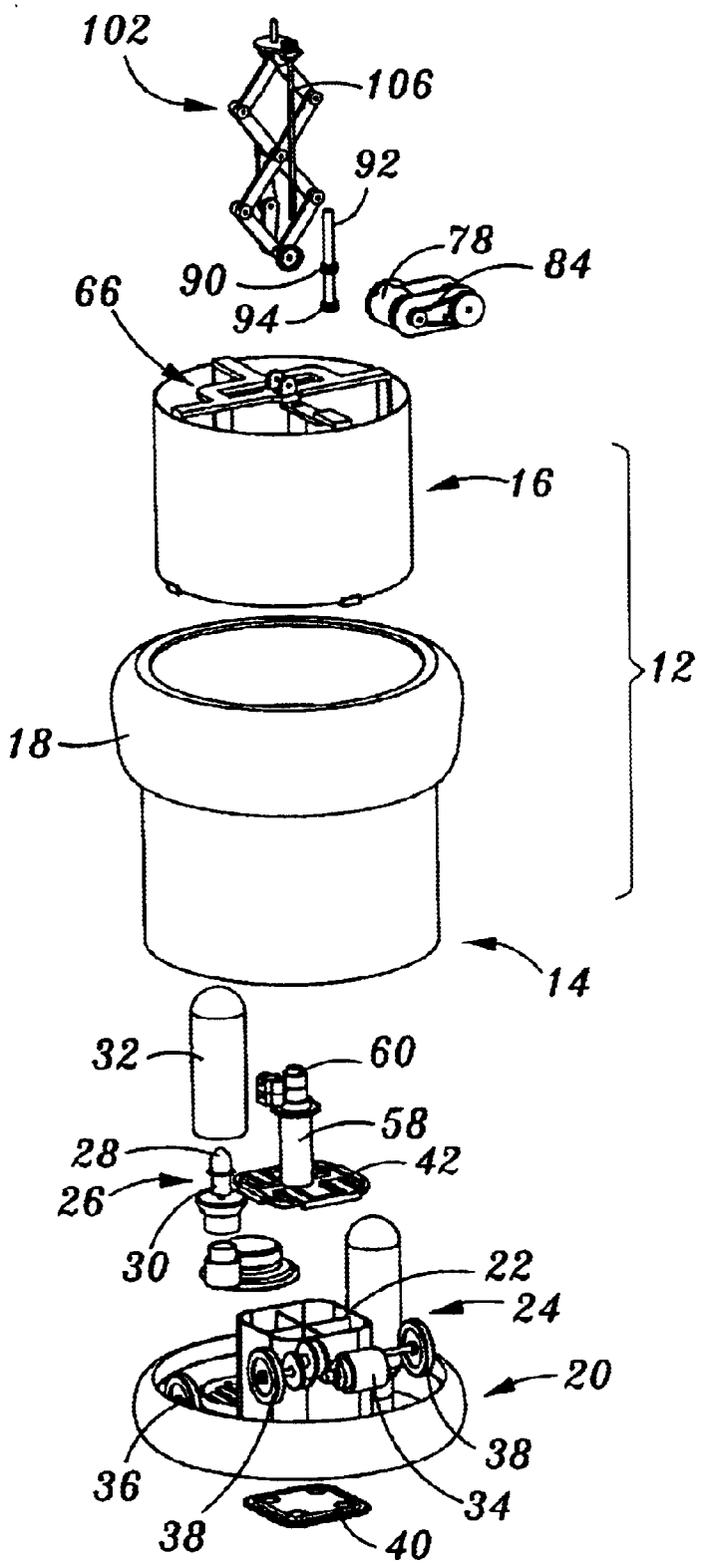
FIG. 5 is an exploded view of the lower telescoping sleeve assembly of the animated display of the first embodiment, further illustrating certain corresponding components of the actuation assembly.

As best seen in FIG. 5, the lower outer sleeve 14 of the lower sleeve assembly 12 is mounted to a circularly configured support base 20 of the animated display 10. The support base 20 includes a battery compartment 22 positioned thereon and extending upwardly therefrom. The battery compartment 22 has a generally square configuration. Also mounted to the support base 20 and extending upwardly along opposed sides of the battery compartment 22 is an identically configured pair of lamp assemblies 24. The lamp assemblies 24 are in electrical communication with the battery compartment 22 and each include a lamp fixture 26 comprising a light bulb 28 mounted to a support post 30. Each lamp assembly 24 further comprises a cylindrical, tubular shroud 32 which is advanceable over the light bulb 28 and attached to the corresponding support post 30. Each shroud 32 may be fabricated from a transparent or translucent material of any desired color.

Mounted to one side of the battery compartment 22 is a drive motor 34. The drive motor 34 is operatively coupled to a plurality of wheels 36 within the support base 20 via a gear train including a series of mechanically coupled drive gears 38. The drive motor 34 is also electrically connected to the battery compartment 22. The activation of the drive motor 34 is operative to facilitate the rotation of the wheels 36, and hence the linear or rotational movement of the animated display 10 along a generally planar surface.

In the animated display 10, the lower end of the battery compartment 22 is normally covered by a compartment door 40. As will be recognized, the detachment of the compartment door 40 from the support base 20 allows for the placement of batteries into the interior of the battery compartment 22. Attached to the upper end of the battery compartment 22 is a compartment cover 42. As seen in FIGS. 1 and 2, the annular peripheral wall of the support base 20 may include decorative indicia attached to the outer surface thereof.

Figure 6:
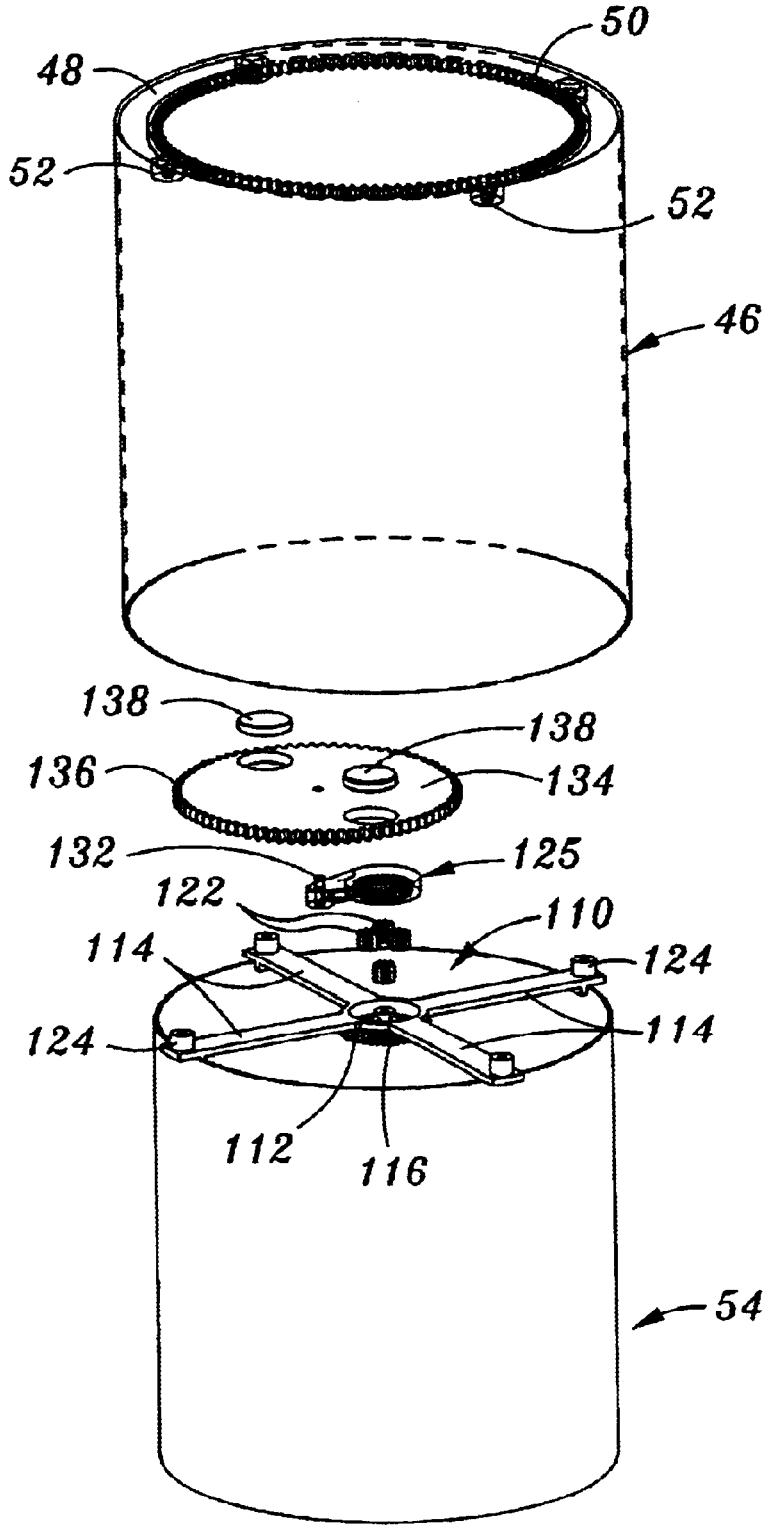
FIG. 6 is an exploded view of the upper telescoping sleeve assembly of the animated display of the first embodiment, further illustrating certain corresponding components of the actuation assembly.

In addition to the lower sleeve assembly 12, the animated display 10 comprises an upper sleeve assembly 44. As best seen in FIG. 6, the upper sleeve assembly 44 comprises a cylindrically configured, tubular upper outer sleeve 46. The upper outer sleeve 46 defines an annular flange portion 48 which extends radially inward from the top end thereof. The inner peripheral edge of the flange portion 48 is formed to define gear teeth 50 for reasons which will be discussed in more detail below. Additionally, formed on the inner surface of the flange portion 48 are four cylindrically configured attachment bosses 52 which are equidistantly spaced at intervals of approximately 90°. The use of the bosses 52 will also be discussed in more detail below.

In addition to the upper outer sleeve 46, the upper sleeve assembly 44 includes a generally cylindrical, tubular upper inner sleeve 54. In the upper sleeve assembly 44, the upper inner sleeve 54 is concentrically positioned within the upper outer sleeve 46. Additionally, the upper outer and inner sleeves 46, 54 are sized relative to each other such that an annular gap of substantially uniform width is defined therebetween when the upper inner sleeve 54 is advanced into the upper outer sleeve 46. Like the lower outer and inner sleeves 14, 16, the upper outer sleeve 46 is preferably fabricated from a transparent material, and may include decorative indicia thereon. The upper inner sleeve 54 is itself preferably fabricated from a translucent material and may also include decorative indicia thereon.

Figure 7:
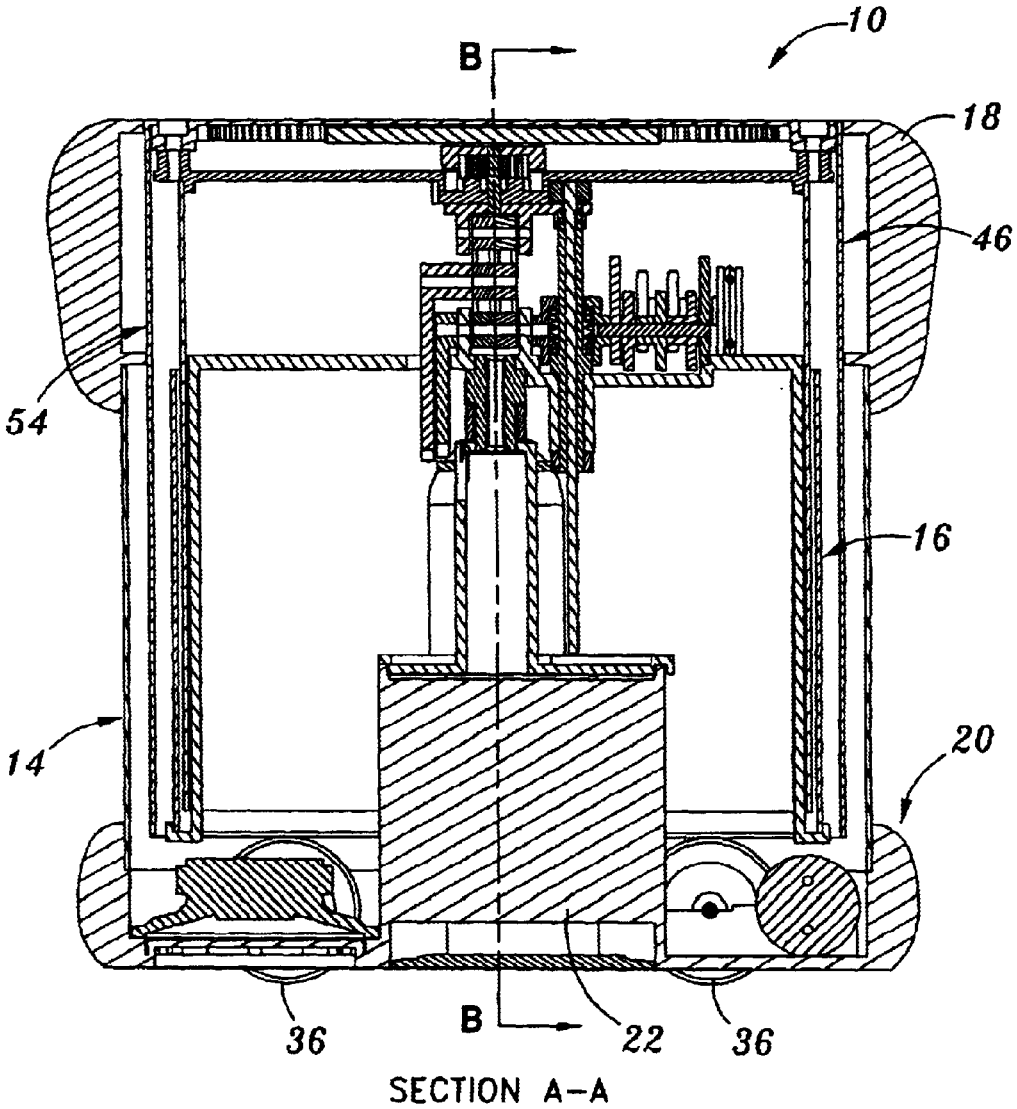
FIG. 7 is a cross-sectional view of the upper and lower telescoping sleeve assemblies and actuation assembly of the animated display of the first embodiment while in its retracted configuration.
Figure 8:
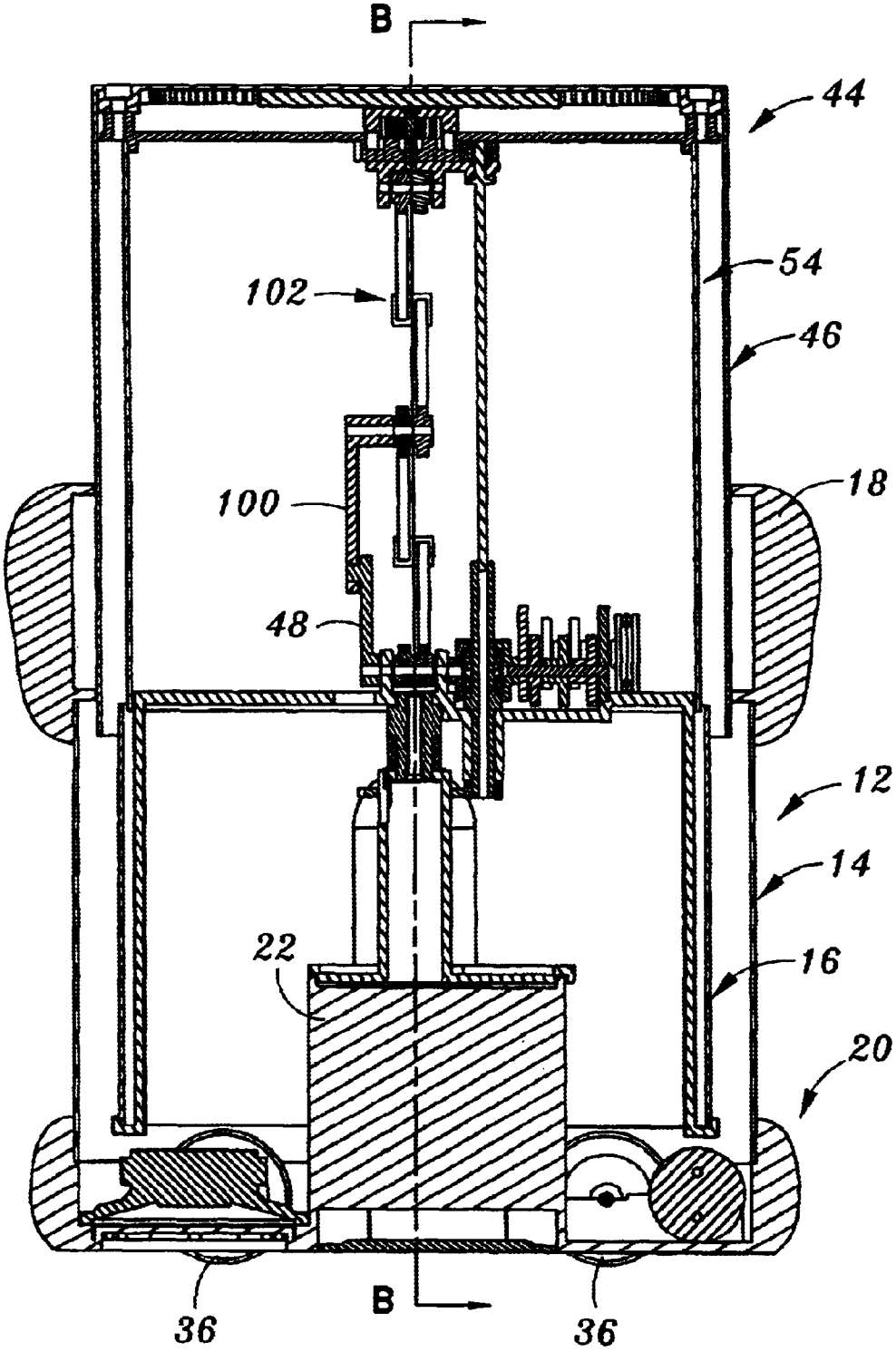
FIG. 8 is a cross-sectional view of the upper and lower telescoping sleeve assemblies and actuation assembly of the animated display of the first embodiment while in its extended configuration.

Referring now to FIGS. 1, 2, 7 and 8, in the animated display 10, the lower and upper sleeve assemblies 12, 44 are cooperatively engaged to each other such that the upper sleeve assembly 44 is selectively moveable between a retracted position (shown in FIGS. 1 and 7) and an extended position (shown in FIGS. 2 and 8) relative to the lower sleeve assembly 12. More particularly, as is most apparent from FIGS. 7 and 8, the lower and upper sleeve assemblies 14, 16 are cooperatively engaged to each other such that the lower inner sleeve 16 of the lower sleeve assembly 12 is in substantial alignment with the gap defined between the upper outer and inner sleeves 46, 54 of the upper sleeve assembly 44. As seen in FIG. 7, when the upper sleeve assembly 44 is actuated to its retracted position, the lower inner sleeve 16 is advanced into and resides within the gap defined between the upper outer and inner sleeves 46, 54. As seen in FIG. 8, the elevation of the upper sleeve assembly 44 to its extended position facilitates the almost complete removal of the lower inner sleeve 16 from between the upper outer and inner sleeves 46, 54. The movement of the upper sleeve assembly 44 between its extended and retracted positions relative to the lower sleeve assembly 12 occurs in a telescoping fashion.

Due to the preferred material selection for the lower outer and inner sleeves 14, 16 and upper outer and inner sleeves 46, 54, when the upper sleeve assembly 44 is in its retracted position, the decorative indicia on the upper outer sleeve 46 is visually observable through the transparent lower outer sleeve 14. Additionally, the decorative indicia on the translucent lower inner sleeve 16 is visually observable through the transparent lower and upper outer sleeves 14, 46. When the upper sleeve assembly 44 is elevated to its extended position, the decorative indicia on the translucent lower inner sleeve 16 is visually observable through the transparent lower outer sleeve 14. Additionally, the decorative indicia on the translucent upper inner sleeve 54 is visually observable through the transparent upper outer sleeve 46.

As is also apparent from FIGS. 7 and 8, the collar 18 of the lower sleeve assembly 12 is operative to cover or shield portions of the decorative indicia included on the upper outer and inner sleeves 46, 54. More particularly, when the upper sleeve assembly 44 is lowered to its retracted position, the decorative indicia included on the top portions of the upper outer and inner sleeves 46, 54 is covered or obscured by the collar 18. Conversely, when the upper sleeve assembly 44 is elevated to its extended position, the decorative indicia on the bottom portions of the upper outer and inner sleeves 46, 54 is covered by the collar 18. In this regard, it is contemplated that the upper outer sleeve 46 may be provided with two distinct decorative scenes, with one such scene being included on the upper half thereof and another scene being included on the lower half thereof. When the upper sleeve assembly 44 is in its retracted position, the decorative scene on the upper half of the upper outer sleeve 46 would be covered by the collar 18 and thus not observable, with the decorative scene on the lower half being observable through the transparent lower outer sleeve 14. When the upper sleeve assembly 44 is moved to its elevated position, the decorative scene on the upper half of the upper outer sleeve 46 would be exposed and thus viewable, with the decorative scene on the lower half of the upper outer sleeve 46 being covered by the collar 18 and thus not observable.

Referring now to FIGS. 3–5 and 9–12, the movement of the upper sleeve assembly 44 between its extended and retracted positions is facilitated by an actuation assembly 56 of the animated display 10. The actuation assembly 56 is also operative to facilitate the rotation of the lower inner sleeve 16 relative to the lower outer sleeve 14 which is attached to the support base 20 and remains stationary. The actuation assembly 56 is further operative to facilitate the concurrent rotation of the upper outer and inner sleeves 46, 54 of the upper sleeve assembly 44.

The actuation assembly 56 of the animated display 10 comprises a cylindrically configured support column 58 which is attached to and extends upwardly from the compartment cover 42. The top end of the support column 58 is of a reduced diameter relative to the remainder thereof, thus defining an annular shoulder 60. Formed on and extending radially outward from the support column 58 is a gear portion 62, the use of which will be discussed in more detail below. Additionally, disposed on and extending circumferentially about the support column 58 is a pair of conductive bands 64 which are positioned between the gear portion 62 and the shoulder 60.

Figure 3:
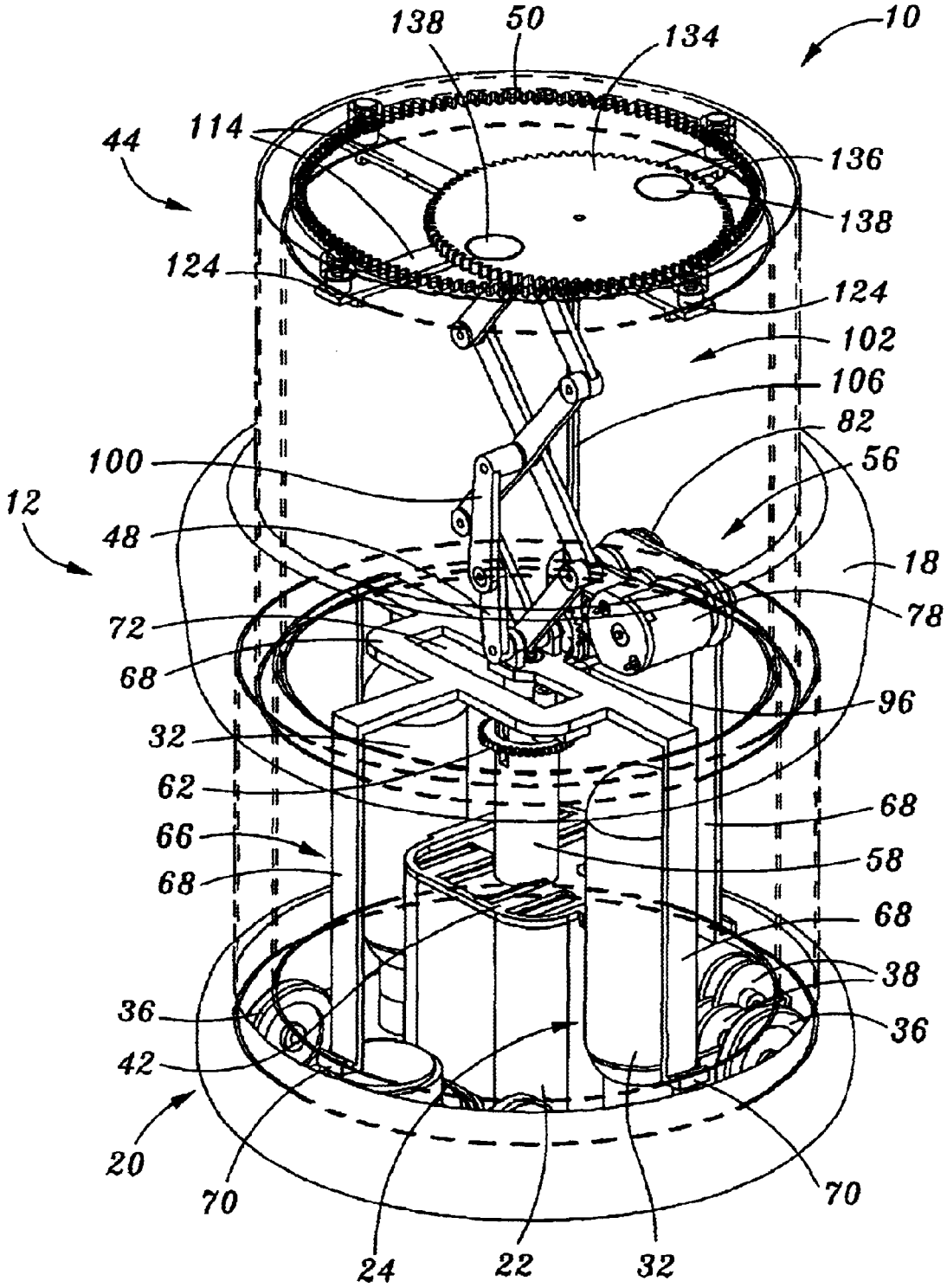
FIG. 3 is a top, front perspective view of the actuation assembly of the animated display of the first embodiment in its extended configuration.
Figure 4:
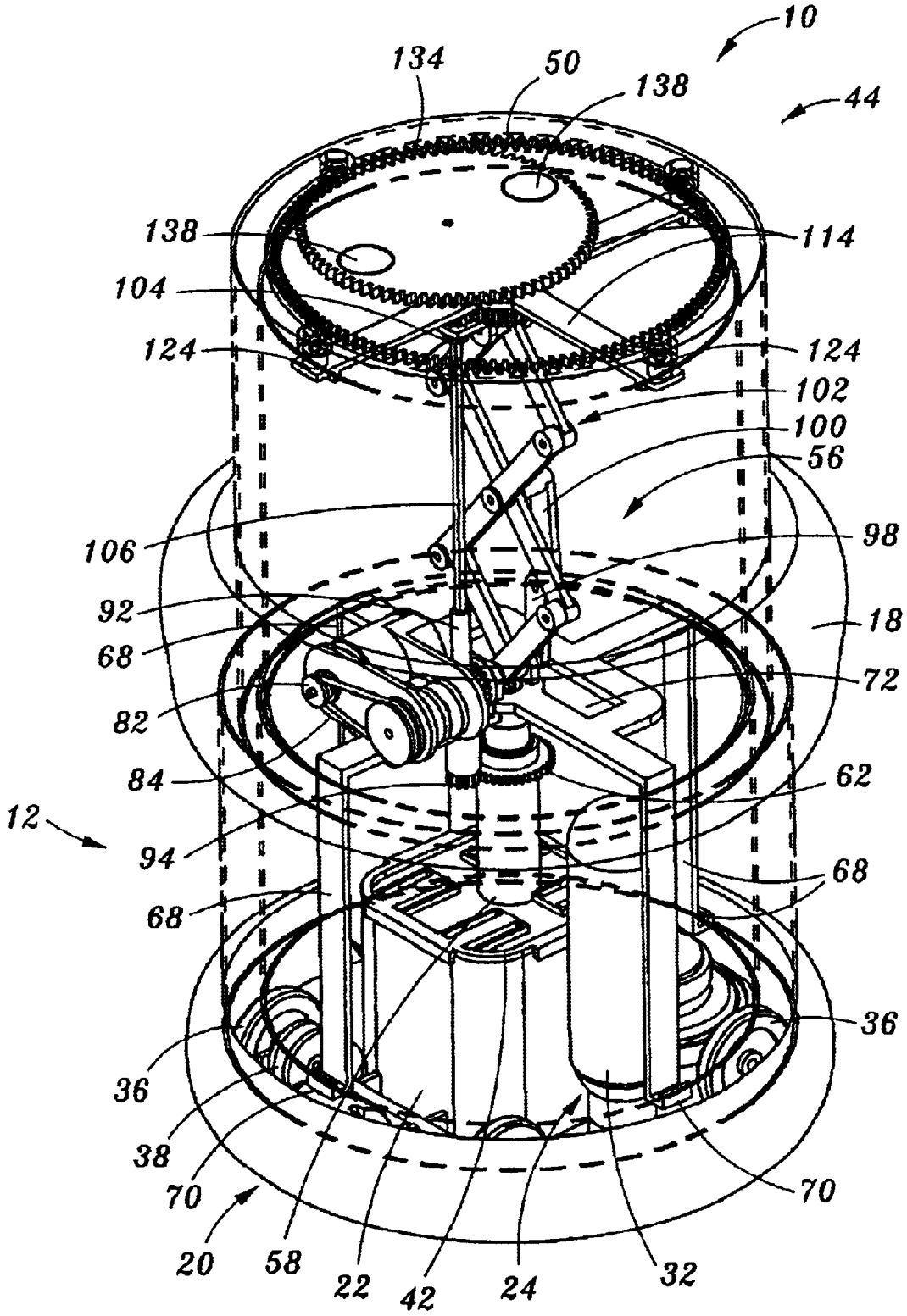
FIG. 4 is a top, rear perspective view of the actuation assembly shown in FIG. 3 with the animated display of the first embodiment being in its extended configuration.

The actuation assembly 56 further comprises a support frame 66 which is rotatably connected to the support column 58, and rests on the shoulder 60 defined thereby. The support frame 66 defines four vertically extending arms 68 which are separated from each other at equidistant intervals of approximately 90 degrees. The bottom end of each of the arms 68 is formed to include an integral support tab 70 which extends laterally outward relative to the remainder of the corresponding arm 68. As is best seen in FIGS. 3 and 4, the lower inner sleeve 16 of the lower sleeve assembly 12 is advanceable over the support frame 66 such that the bottom rim of the lower inner sleeve 16 is captured within each of the support tabs 70. Thus, the lower inner sleeve 16 is carried by the support frame 66 and hence rotatable therewith. As best seen in FIGS. 7 and 8, when the lower inner sleeve 16 is cooperatively engaged to the support frame 66 in the aforementioned manner, an annular gap is defined between the arm 68 of the support frame 66 and the lower inner sleeve 16. This gap allows for the advancement of the upper inner sleeve 54 of the upper sleeve assembly 44 in between the arms 68 of the support frame 66 and the lower inner sleeve 16 when the upper inner sleeve 54 is actuated from its extended position shown in FIG. 8 to its retracted position shown in FIG. 7.

In addition to the arm 68, the support frame 66 further defines a rectangularly configured opening 72. Additionally, the support frame 66 includes a pair of upwardly extending ears 74 which are disposed in spaced relation to each other, and a downwardly extending tubular boss 76 having a generally cylindrical configuration.

Figure 13:
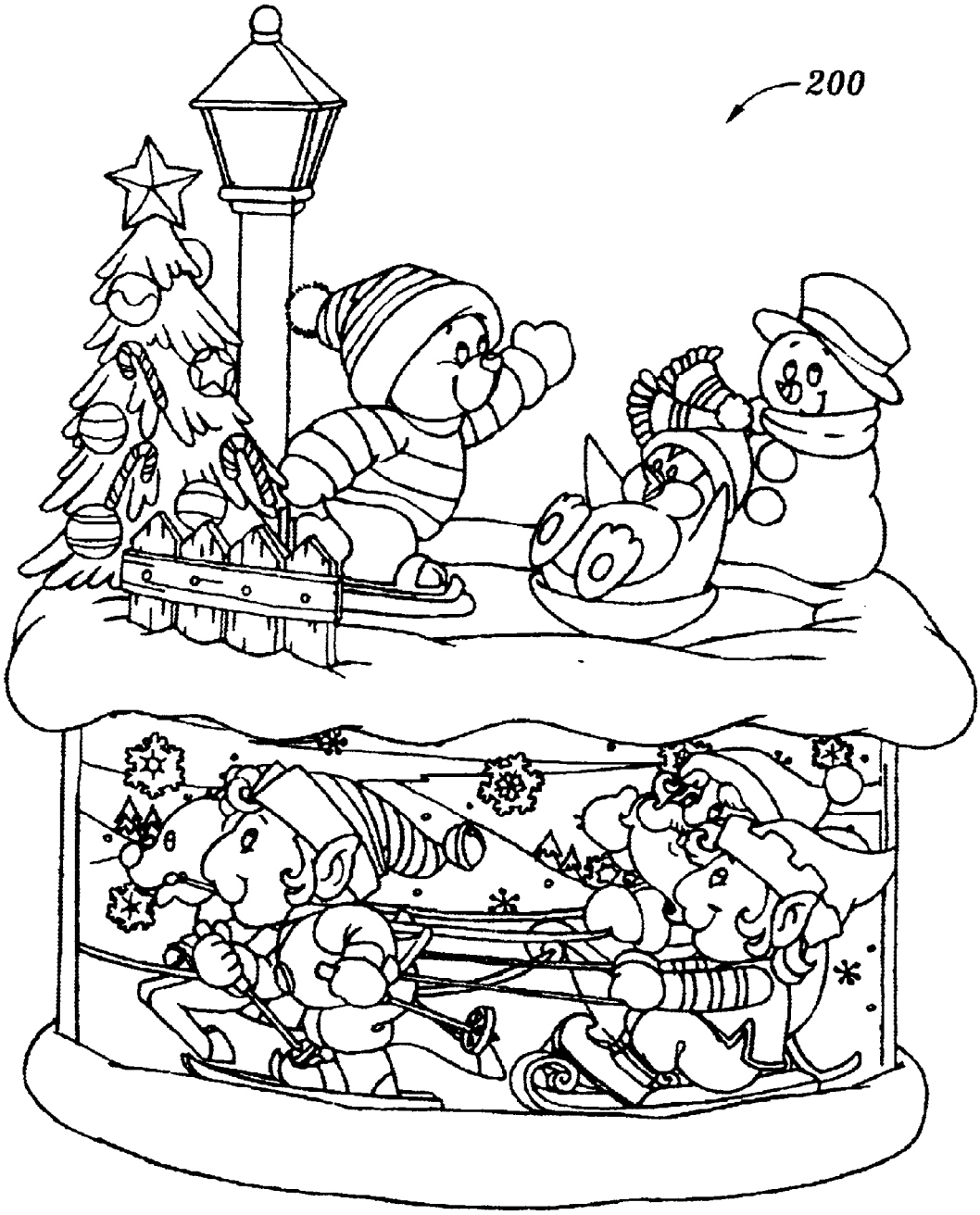
FIG. 13 is a perspective view of an animated display constructed in accordance with a second embodiment of the present invention in its retracted configuration.
Figure 14:
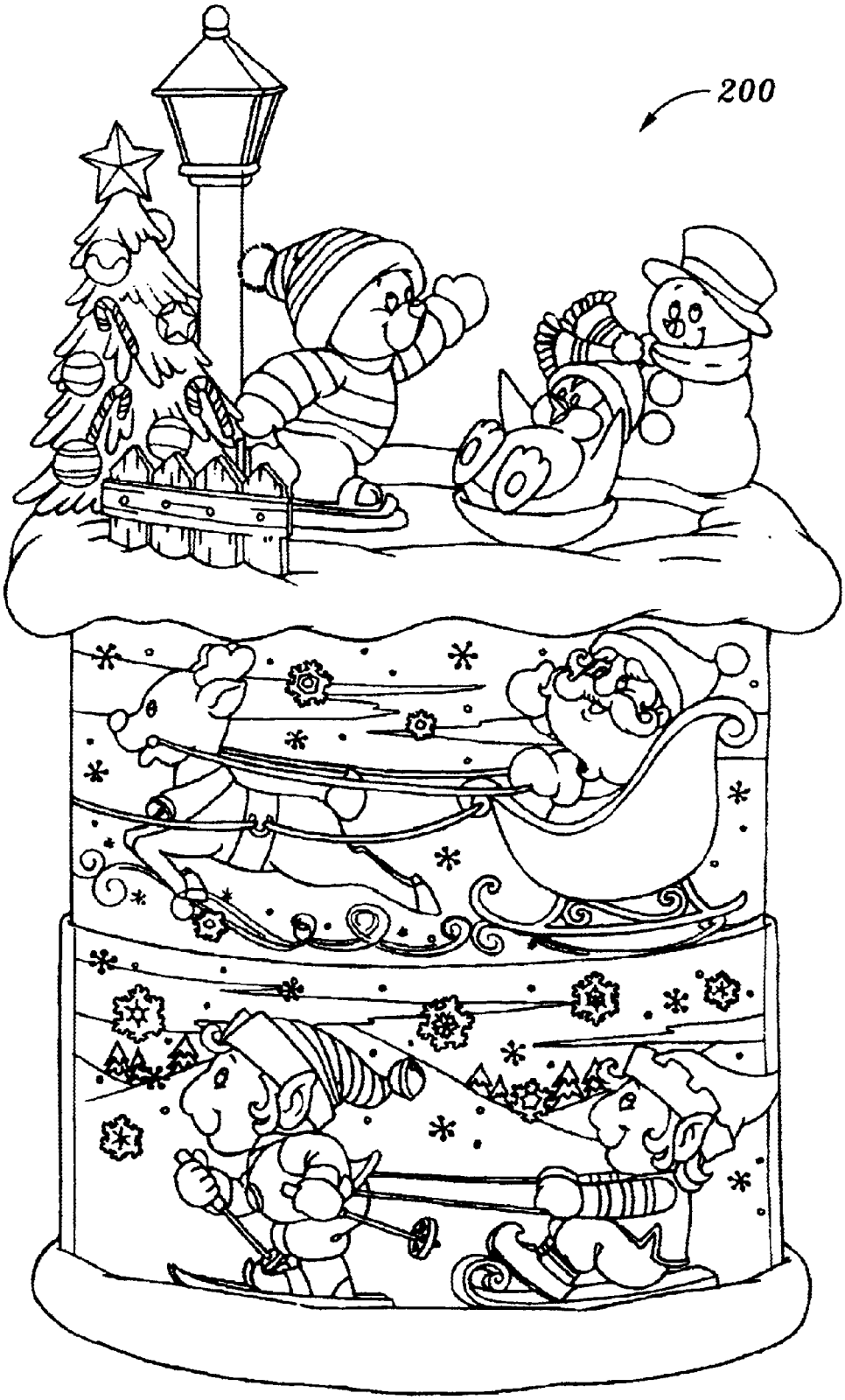
FIG. 14 is a perspective view of the animated display of the second embodiment in its extended configuration.
Figure 15:
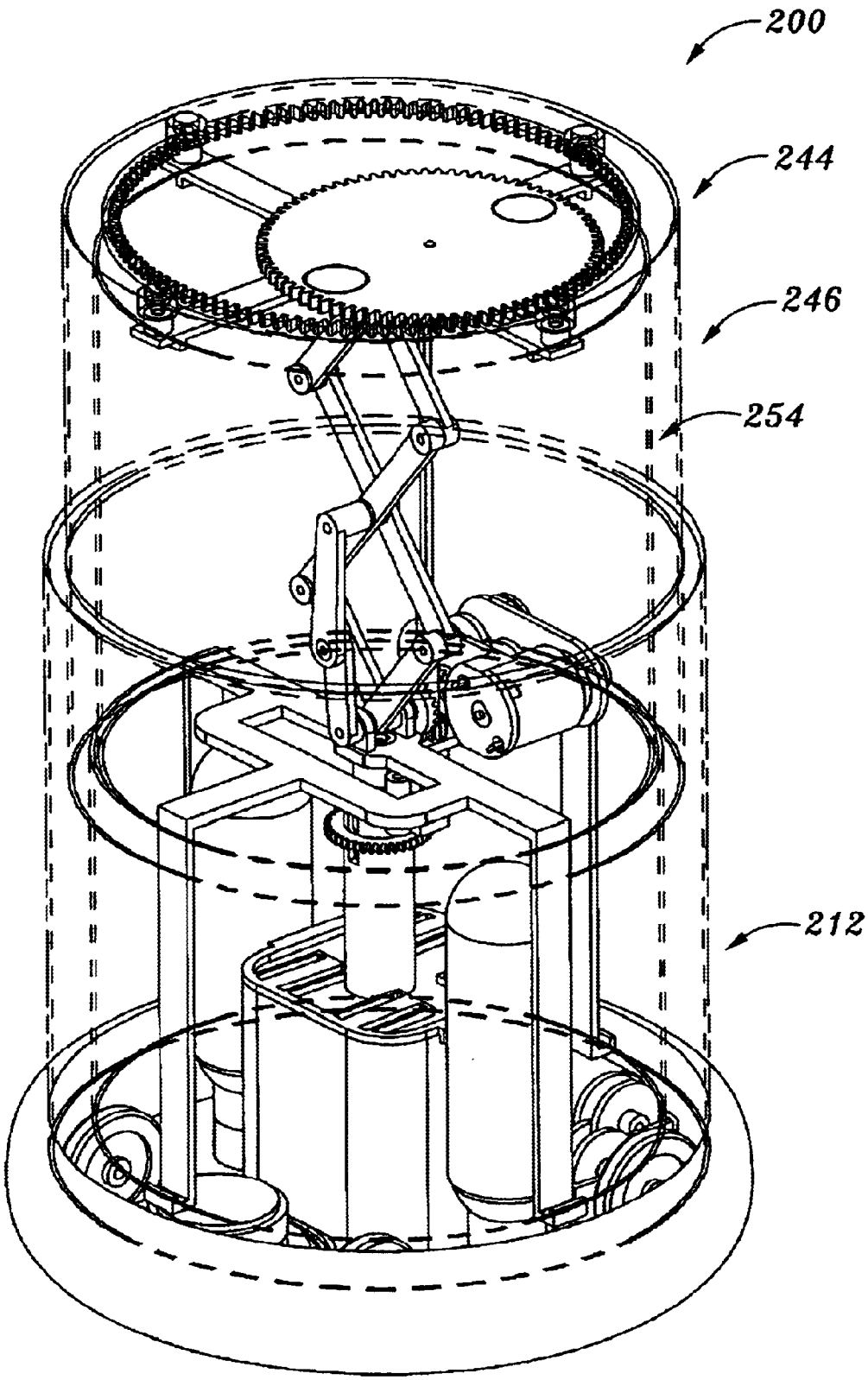
FIG. 15 is a front, top perspective view of the actuation assembly of the animated display of the second embodiment.
Figure 16:
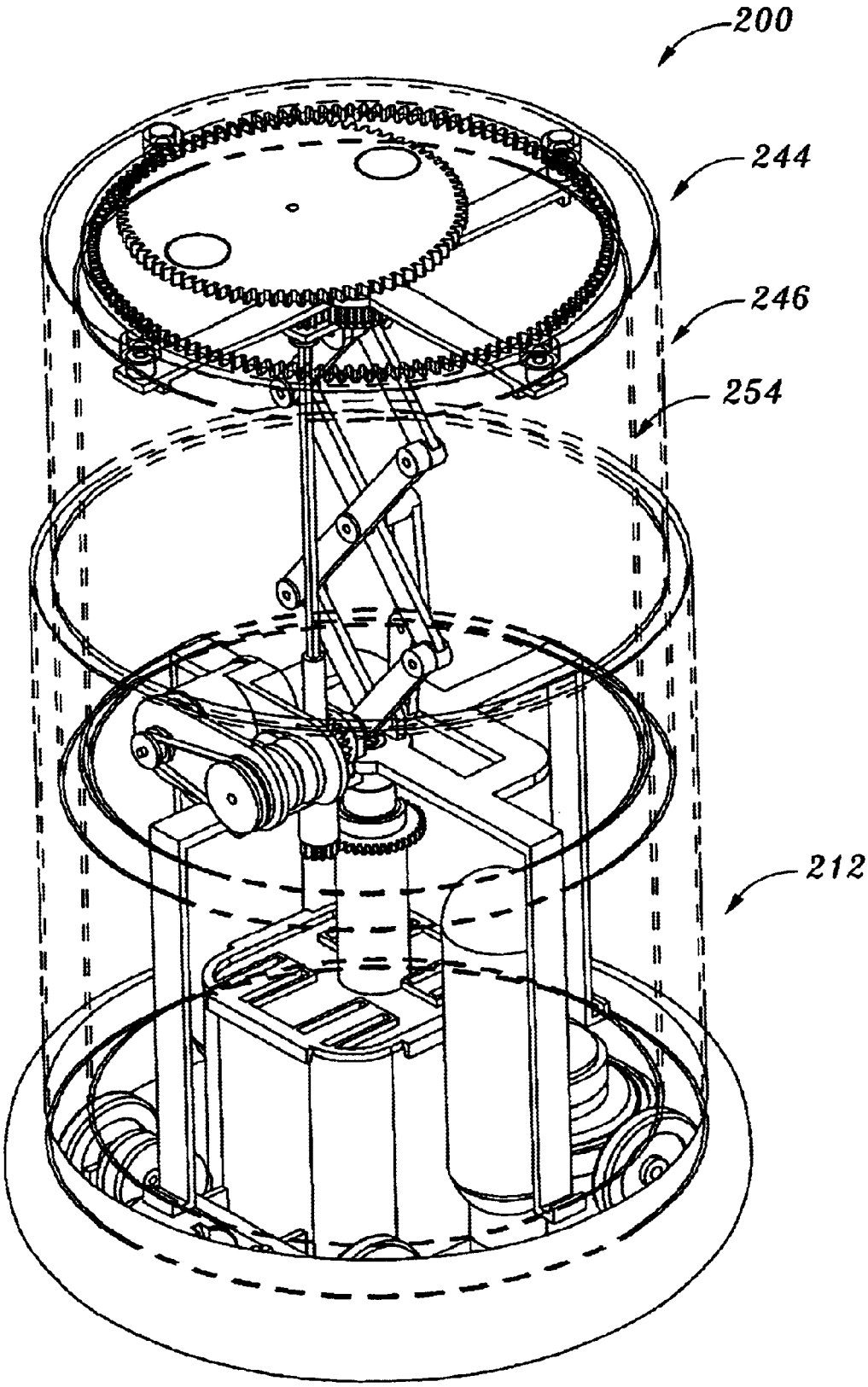
FIG. 16 is a top, rear perspective view of the actuation assembly of the animated display of the second embodiment.
Figure 17:
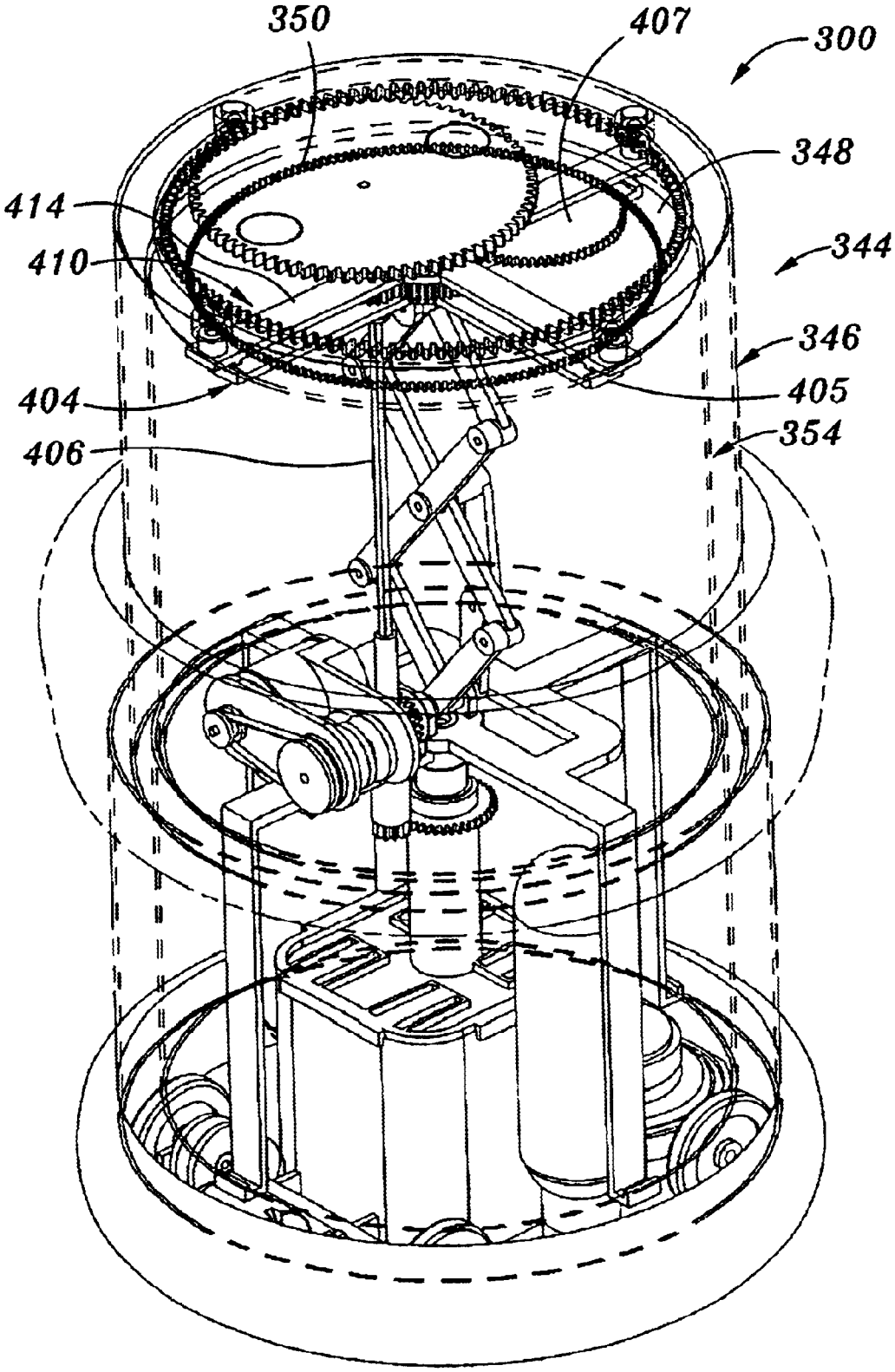
FIG. 17 is a top, rear perspective view of the actuation assembly of an animated display constructed in accordance with a third embodiment of the present invention.

The actuation assembly 56 further comprises an actuation motor 78 which is attached to the top of the support frame 66. The actuation motor 78 is mechanically coupled to a first crown gear 80 (best shown in FIG. 13) via a pair of pulleys 82 interconnected by a drive belt 84, and a gear train 86 disposed between one of the pulleys 82 and the first crown gear 80. The remaining pulley 82 is attached to a motor shaft 88 of the actuation motor 78. Thus, the rotation of the motor shaft 88 at a first speed upon the activation of the actuation motor 78 facilitates the rotation of the first crown gear 80 in either a clockwise or counter-clockwise direction at a second speed which is slower than the rotational speed of the drive shaft 88.

The first crown gear 80 is intermeshed with the gear portion 90 formed on the bottom end of a tubular drive shaft 92 rotatably connected to the top of the support frame 66. The drive shaft 92 is attached to a gear 94 disposed at the bottom of the boss 76 via a connecting rod extending through the boss 76. Thus, the rotation of the gear portion 90 and hence the drive shaft 92 as a result of the rotation of the first crown gear 80 facilitates the concurrent rotation of the gear 94. The gear 94 is itself intermeshed with the gear portion 62 of the support column 58. Due to the intermesh between the gear 94 and gear portion 62, and rotatable attachment of the support frame 66 to top end of the support column 58, the rotation of the gear 94 causes the same to travel about the periphery of the stationary gear portion 62, thus in turn facilitating the rotation of the support frame 66 relative to the stationary support column 58. Thus, the activation of the actuation motor 78 facilitates not only the rotation of the drive shaft 92 due to its engagement to the first crown gear 80 via the gear portion 90, but further facilitates the concurrent rotation of the lower inner sleeve 16 due to its engagement to the support frame 66 which is rotated by the engagement between the gear 94 and gear portion 62 of the support column 58.

Figure 9:
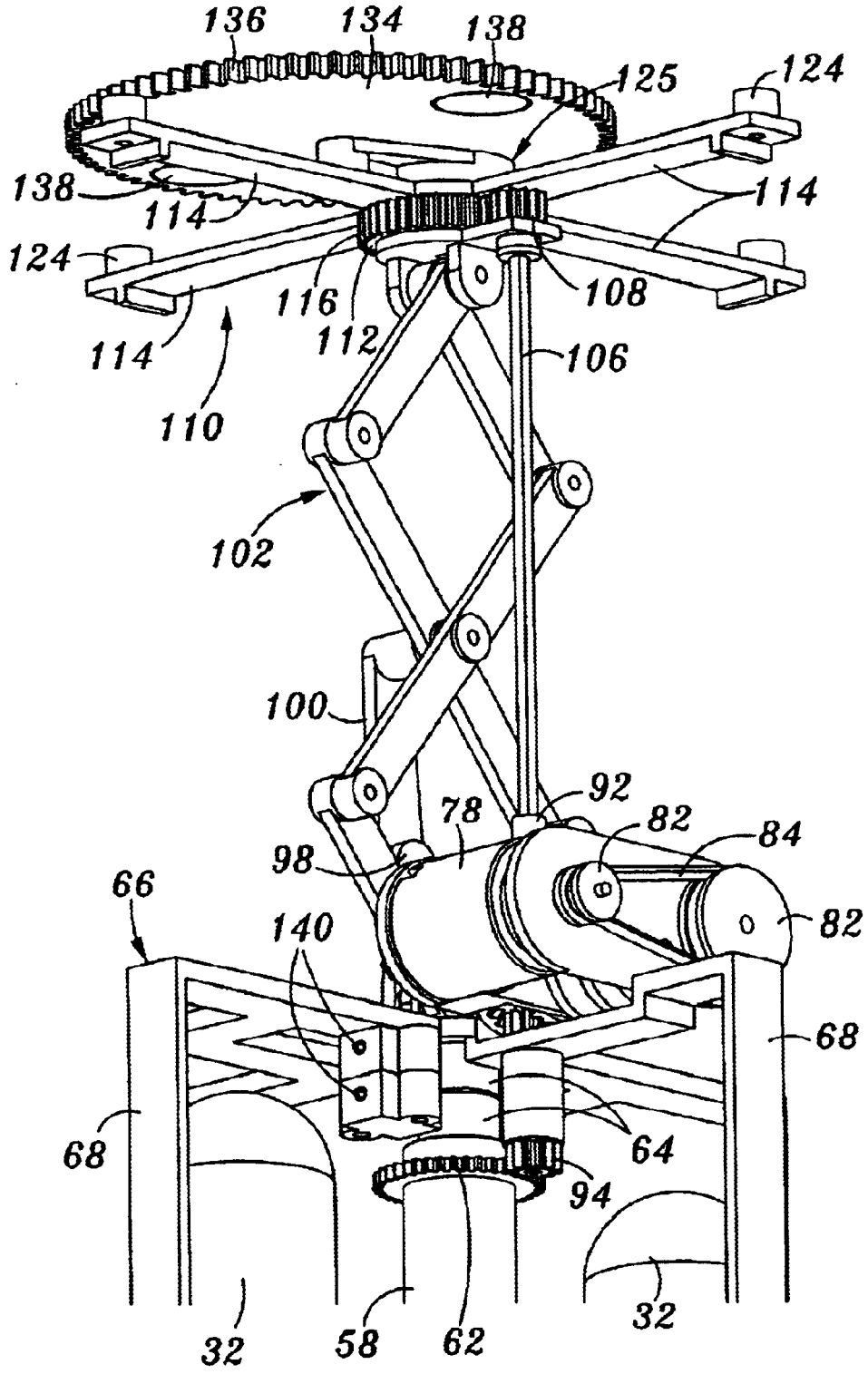
FIG. 9 is a partial, lower perspective view of the actuation assembly of the animated display of the first embodiment.
Figure 10:
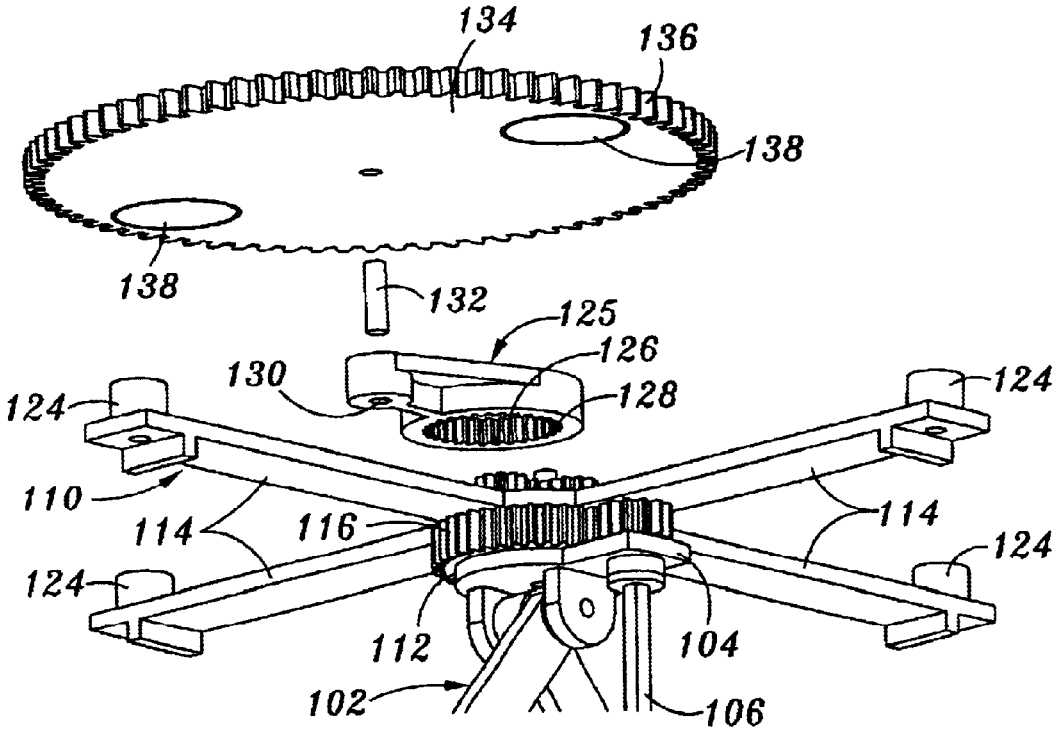
FIG. 10 is an exploded, lower perspective view of the upper portion of the actuation assembly shown in FIG. 9.

Also intermeshed to the gear portion 90 of the drive shaft 92 is a second crown gear 96 of the actuation assembly 56. The second crown gear 96 is attached to one end of a shaft which is rotatably connected to and extends between the ears 74 of the support frame 66. Rigidly attached to the end of the shaft opposite that secured to the second crown gear 96 is one end of a lower drive link 98. Rotatably connected to the opposite end of the lower drive link 98 is one end of an upper drive link 100. The opposite end of the upper drive link 100 is rotatably connected to the approximate center of a scissor link assembly 102 of the actuation assembly 56. The bottom end of the scissor link assembly 102 is pivotally connected to that portion of the shaft interconnecting the second crown gear 96 and lower drive link 98 extending between the ears 74 of the support frame 66. As best seen in FIGS. 9 and 10, the top end of the scissor link assembly 102 is pivotally connected to a support shelf 104.

Due to the intermesh between the second crown gear 96 and the gear portion 90 of the drive shaft 92, the rotation of the first crown gear 80 as a result of the activation of the actuation motor 78 facilitates the rotation of the second crown gear 96 via the gear portion 90 mechanically coupling the first and second crown gears 80, 96 to each other. The rotation of the second crown gear 96 in turn facilitates the rotation of the shaft extending therefrom, and hence the rotation of the lower drive link 98. The formation of the opening 72 within the support frame 66 is to accommodate the rotation of the lower drive link 98, thus allowing the same to be rotated a complete 360 degrees without interfering with the support frame 66.

In the actuation assembly 56, the rotation of the lower drive link 98 is operative to facilitate the reciprocal movement of the scissor link assembly 102 between an extended state (shown in FIGS. 3, 4, 9 and 12) and a retracted or collapsed state. More particularly, the upward rotation of the lower drive link 98 from a six o'clock position to a twelve o'clock position forces the upper drive link 100 upwardly, which in turn forces the scissor link assembly 102 into its fully extended state due to the pivotal connection of the upper drive link 100 to the scissor link assembly 102. Conversely, the downward rotation of the lower drive link 98 from the twelve o'clock position to the six o'clock position draws the upper drive link 100 downwardly which in turn facilitates the collapse of the scissor link assembly 102 to its retracted state. Importantly, the configuration of the lower and upper drive links 98, 100 and manner in which they are engaged to the second crown gear 96 and scissor link assembly 102 results in the scissor link assembly 102 constantly moving between its extended and retracted states despite the second crown gear 96 and hence the lower drive link 98 only being rotated in one direction (i.e., a clockwise direction or a counter-clockwise direction). The scissor link assembly 102 reaches its fully extended state when the lower drive link 98 reaches the twelve o'clock position, with the scissor link assembly 102 beginning movement to its fully retracted state when the lower drive link 98 rotates downwardly beyond the twelve o'clock position. The fully retracted state is reached when the lower drive link 98 reaches the six o'clock position. The movement of the scissor link assembly 102 back toward its fully extended state occurs as the lower drive link 98 moves upwardly from the six o'clock position back toward the twelve o'clock position.

The actuation assembly 56 of the animated display 10 further comprises an elongate drive rod 106, the lower portion of which is slidably inserted into the drive shaft 92. The drive rod 106 has a square cross-sectional configuration which is complimentary to the square cross-sectional configuration of the bore defined by the drive shaft 92. A portion of the drive rod 106 is slidably extensible from and retractable into the drive shaft 92. However, due to the complimentary square cross-sectional configurations of the drive rod 106 and drive shaft 92, the rotation of the drive shaft 92 facilitates the concurrent rotation of the drive rod 106 despite the drive rod 106 being slidably moveable relative to the drive shaft 92.

Figure 11:
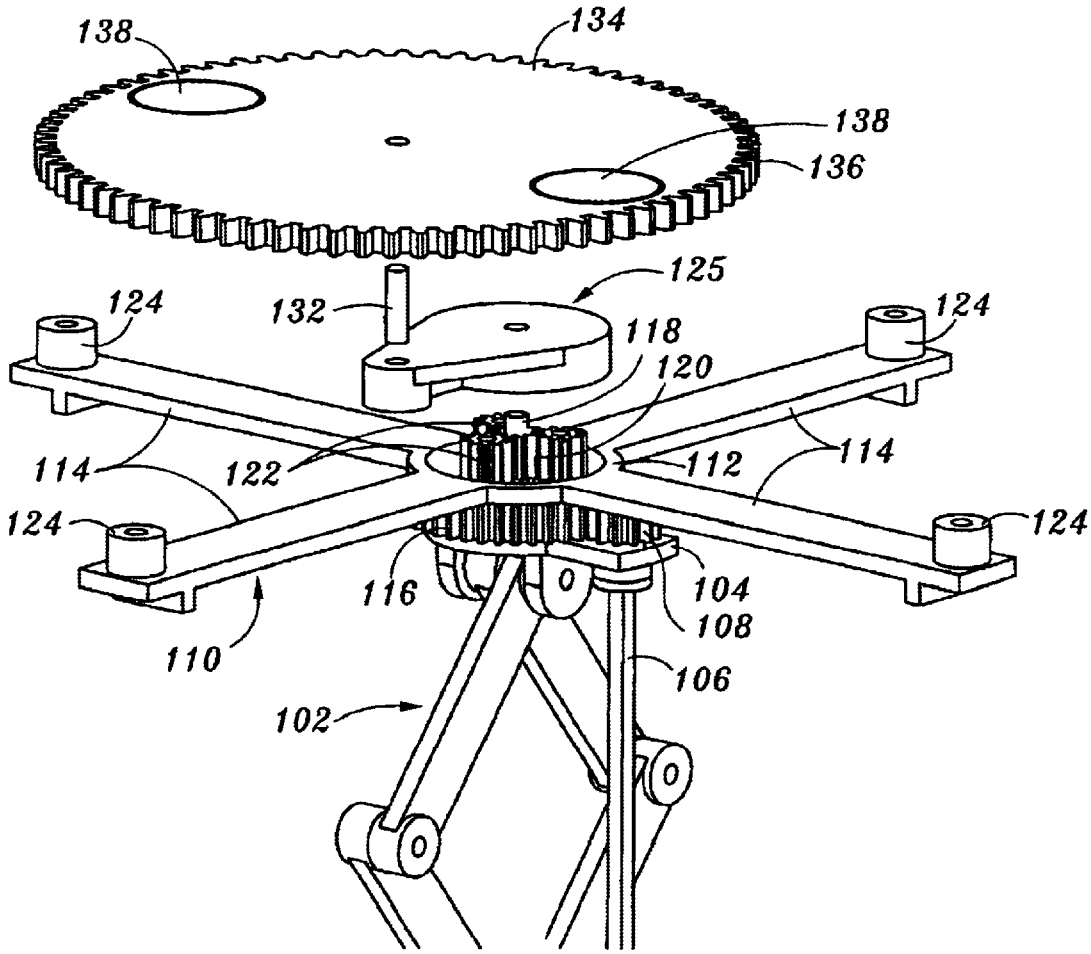
FIG. 11 is an exploded, upper perspective view of the upper portion of the actuation assembly shown in FIG. 9.
Figure 12:
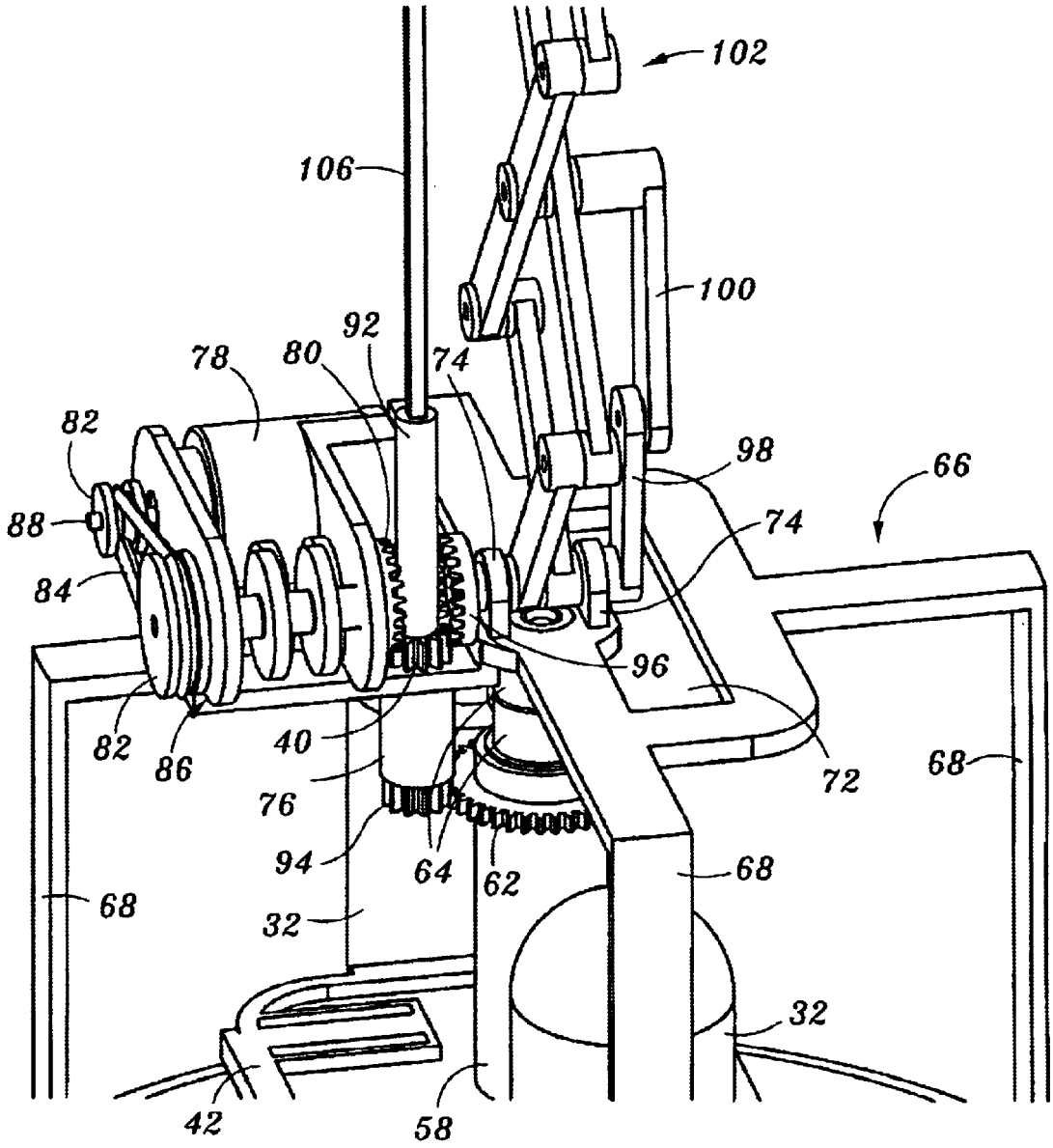
FIG. 12 is a partial, upper perspective view of the actuation assembly of the animated display of the first embodiment.

As best seen in FIGS. 10 and 11, the top end of the drive rod 106 is rotatably connected to the support shelf 104 and rigidly attached to a gear 108 disposed on the support shelf 104. In this regard, the rotation of the drive rod 106 facilitates the concurrent rotation of the gear 108 upon the support shelf 104. Due to the rotatable connection of the drive rod 106 to the support shelf 104, the movement of the scissor link assembly 102 toward its extended state effectively lifts or raises the support shelf 104 which in turn pulls that portion of the drive rod 106 within the drive shaft 92 from therewithin. Conversely, the movement of the scissor link assembly 102 back toward its retracted state forces the lower portion of the drive rod 106 back into the drive shaft 92. As will be recognized, the drive rod 106 is sized such that at least a portion thereof adjacent its bottom end remains within the bore of the drive shaft 92 even when the scissor link assembly 102 reaches its fully extended state maximizing the separation distance between the support shelf 104 and the support frame 66.

Referring now to FIGS. 6 and 9–11, rotatably connected to the support shelf 104 is a generally cross-shaped support strut 110 which defines a circularly configured central hub 112 having four arms 114 extending radially therefrom at intervals of approximately 90 degrees. The outer surface of the central hub 112 is formed to include gear teeth 116, with the central hub 112 further including a circularly configured opening 117 formed in the top thereof. Extending axially within the opening 117 is a shaft 118 of the support strut 110 which is integrally connected to the central hub 112 and includes a gear 120 mounted thereto. The gear 120 is intermeshed with three identically configured planetary gears 122 which are rotatably mounted to the central hub 112 of the support strut 110 and are spaced about the shaft 118 and hence the gear 120 at intervals of approximately 120 degrees. The gear teeth 116 of the central hub 112 are intermeshed with the gear 108 attached to the top end of the drive rod 106. As such, the rotation of the drive rod 106 and hence the gear 108 facilitates the rotation of the support strut 110 upon the support shelf 104. The rotation of the support strut 110 in turn facilitates the rotation of the shaft 118 and hence the gear 120 mounted thereto.

As best seen in FIG. 6, the upper inner sleeve 54 of the upper sleeve assembly 44 is attached to the support strut 110, and more particularly to the undersides of the outer ends of the arms 114 thereof. Thus, the upper inner sleeve 54 rotates concurrently with the support strut 110. Also attached to the support strut 110 is the upper outer sleeve 46, with such attachment being facilitated by the advancement of fasteners through the bosses 52 of the upper outer sleeve 46 into complimentary bosses 124 formed on the upper surfaces of respective ones of the arms 114 adjacent the distal ends thereof. Thus, the upper outer sleeve 46 also rotates concurrently with the support strut 110, with the rotational speed of the upper outer and inner sleeves 46, 54 being the same due to both being attached to the support strut 110.

As further seen in FIGS. 10 and 11, mechanically coupled to the planetary gears 122 is a plate holder 125 which defines a circularly configured central opening 126 having gear teeth 128 formed about the peripheral inner surface thereof. The plate holder 125 is advanceable over the planetary gears 122 such that the planetary gears 122 reside within the opening 126 and are intermeshed to the gear teeth 128. The plate holder 125 further defines a shaft aperture 130 which is radially offset relative to the shaft 118 of the support strut 110 when the plate holder 125 is mechanically coupled to the planetary gears 122 in the aforementioned manner. Rotatably received into the shaft aperture 130 is the lower portion of a plate shaft 132, the top end of which is attached to a circularly configured display plate 134. The display plate 134 is formed to include gear teeth 136 about the peripheral edge thereof. Additionally, disposed within the display plate 134 adjacent the peripheral edge thereof is a pair of circularly configured magnets 138 which are separated from each other by an interval of approximately 180 degrees.

The display plate 134 comprises the upper most component of the actuation assembly 56. As best seen in FIGS. 3 and 4, when the animated display 10 is completely assembled, the gear teeth 136 of the display plate 134 are intermeshed with the gear teeth 50 formed on the flange portion 48 of the upper outer sleeve 46. As indicated above, the rotation of the gear 108 by the drive rod 106 facilitates the rotation of the support strut 110 upon the support shelf 104 due to the intermesh between the gear 108 and the gear teeth 116. In view of the intermesh between the gear 120 and planetary gears 122 and between the planetary gears 122 and gear teeth 128 of the plate holder 125, a rotation of the shaft 118 of the support strut 110 and hence the gear 120 facilitates the concurrent rotation of the plate holder 125. Due to the shaft aperture 130 being radially offset from the shaft 118, the rotation of the plate holder 125 results in the concurrent rotation of the plate shaft 132 and hence the display plate 134 about the axis of the shaft 118. Further, due to the intermesh between the gear teeth 136 and the gear teeth 50 of the upper outer sleeve 46, the movement of the display plate 134 about the axis of the shaft 118 facilitates the concurrent rotation of the display plate 134 about the axis of the plate shaft 132.

In summary, the operation of the actuation assembly 56 is as follows. The activation of the actuation motor 78 facilitates the rotation of the first crown gear 80 via the pulleys 82, drive belt 84, and gear train 86. The rotation of the first crown gear 80 facilitates the concurrent rotation of the drive shaft 92 attributable to the intermesh between the first crown gear 80 and the gear portion 90 of the drive shaft 92. The intermesh between the gear portion 90 of the drive shaft 92 and second crown gear 96 facilitates the concurrent rotation of the second crown gear 96 and hence the lower drive link 98 attached thereto. The rotation of the lower drive link 98 facilitates the intermittent upward and downward movement of the upper drive link 100, which in turn facilitates the movement of the scissor link assembly 102 between its extended and retracted states in the above-described manner.

As the scissor link assembly 102 is being moved continuously between its extended and retracted states, the rotation of the drive shaft 92 also facilitates the concurrent rotation of the gear 94. The intermesh between the gear 94 and the gear portion 62 of the support column 58 facilitates the rotational movement of the support frame 66 and hence the lower inner sleeve 16 about the central axis of the support column 58. The rotation of the drive shaft 92 also facilitates the concurrent rotation of the drive rod 106 which in turn facilitates the rotation of the support strut 110 due to the intermesh between the gear 108 and gear teeth 116 on the central hub 112. The rotation of the support strut 110 facilitates the concurrent rotation of the upper outer and inner sleeves 46, 54 attached thereto, as well as the rotation of the gear 120 attached to the shaft 118 extending axially within the opening 117 of the central hub 112. The rotation of the gear 120 facilitates the concurrent rotation of the plate holder 125 due to the intermesh between the gear 120 and planetary gears 122, and the intermesh between the planetary gears 122 and the gear teeth 128 formed within the opening 126 of the plate holder 125.

The rotation of the plate holder 124 facilitates the rotation of the plate shaft 132 about the axis of the shaft 118. The intermesh between the gear teeth 136 of the display plate 134 and gear teeth 50 of the upper outer sleeve 46 facilitates the rotation of the display plate 134 about the axis of the plate shaft 132 as the plate shaft 132 rotates about the axis of the shaft 118.

It is contemplated that in the completed animated display 10, decorative indica may be attached to the top of the upper sleeve assembly 44, and more particularly to the top of the upper outer sleeve 46 thereof. Such decorative indica may include, for example, one or more ice skating figurines which are caused to move in a particular pattern attributable to the location of the magnets 138 within the rotating display plate 134, and rotation of the display plate 134 about the axis of the shaft 118.

In the actuation assembly 56, the actuator motor 78 rides on the support frame 66. As best seen in FIG. 9, also mounted to the support frame 66 is a pair of electrical contacts 140 which are electrically connected to the actuator motor 78 and are maintained in sliding, conductive contact with respective ones of the conductive bands 64 disposed on the support column 58. The conductive bands 64 are themselves electrically connected to the batteries within the battery compartment 22 to which the support column 58 is attached. As the support frame 66 rotates upon the support column 58 about the axis defined thereby, the contacts 140 are maintained in conductive contact with the conductive bands 64 despite rotating thereabout. The electrical communication between the contacts 140 and conductive bands 64 provides electrical power from the batteries within the battery compartment 22 to the actuator motor 78. Thus, no wires are included which could potentially wrap about the support column 58 as the actuator motor 78 rotates thereabout concurrently with the support frame 66.

As will be recognized, in the animated display 10, the movement of the scissor link assembly 102 of the actuation assembly 56 to its fully extended state results in the concurrent movement of the upper sleeve assembly 44 to its extended position due to the attachment of the upper outer and inner sleeves 46, 54 to the support strut 110. Conversely, the movement of the scissor link assembly 102 to its fully collapsed or retracted state facilitates the movement of the upper sleeve assembly 44 to its retracted position within the lower sleeve assembly 12. It will be recognized that the display plate 134 is raised and lowered with the upper sleeve assembly 44. It will further be recognized that the sizes of the various gears included in the actuation assembly 56 may be selected such that different relative rotational speeds between the various components may be achieved as desired.

The animated display 10 of the present invention further includes control circuitry which controls and coordinates the various movements thereof. In this regard, the control circuitry is in electrical communication with the drive motor 34, actuation motor 78, lamp assemblies 24, and an optional sound/music-emitting element which may be included in the animated display 10. The control circuitry may be programmed to coordinate the movement of the animated display 10 along a planar surface, the movement of the upper sleeve assembly 44 between its retracted and extended positions, the activation of the lamp assemblies 24, and the generation of sound/music from a sound/music producing element (if included) in any desired manner. It is contemplated that the control circuitry, which will include one or more integrated circuit chips, may be disposed in virtually any location within the interior of the animated display 10.

It is further contemplated that the animated display 10 of the present invention may be provided with photo and/or sound sensors which are used to facilitate the activation of the control circuitry. In this regard, the operation of the animated display 10 may be commenced by motion and/or sound. Since the animated display 10 is capable of traveling along a generally planar surface, it is also contemplated that multiple photo sensors may be included in the annular peripheral wall of the support base 20. Such sensors would also be in electrical communication with the control circuitry and used to sense, for example, an edge of a table or some other obstruction. In this regard, the sensors would be used to prevent the animated display 10 from traveling or moving off the edge of a table or running into some object positioned thereon. Still further, it is contemplated that the animated display 10 may be outfitted with an infrared transceiver which is also electrically connected to the control circuitry and used to provide interactive communication with, for example, another animated display 10 or some other interactive device.

In the animated display 10, the lower outer and inner sleeves 14, 16 of the lower sleeve assembly 12 are each described as having cylindrical, tubular configurations. Similarly, the upper outer and inner sleeves 46, 54 of the upper sleeve assembly 44 are described as having cylindridal, tubular configurations. Those of ordinary skill in the art will recognize that the lower outer and inner sleeves 14, 16 may be fabricated in any combination of different shapes or forms. Since the lower inner sleeve 16 is rotatable relative to the lower outer sleeve 14, the sole requirement is that there be sufficient clearance between the lower outer and inner sleeves 14, 16 to allow for such relative rotation irrespective of the shapes thereof. Thus, by way of example, the lower outer sleeve 14 could have a cylindrical configuration, with the lower inner sleeve 16 having a square or triangular tubular configuration, so long as sufficient clearance is defined between the lower outer and inner sleeves 14, 16 to allow for the rotation of the lower inner sleeve 16 within the lower outer sleeve 14. Though the upper outer and inner sleeves 46, 54 are rotated concurrently, the same may also be provided in any combination of different shapes or forms so long as sufficient clearance is defined between the lower and upper sleeve assemblies 12, 44.

It is contemplated that the lower outer and inner sleeves 14, 16 and the upper outer and inner sleeves 48, 54 will be fabricated from a material such as plastic or glass which can be made transparent or translucent. Other suitable materials would be paper and fabrics or combinations of various materials. Irrespective of their shape, one or more of the lower outer and inner sleeves 14, 16 and upper outer and inner sleeves 46, 54 may be fabricated in a manner wherein the decorative indicia comprises three-dimensional relief created by vacuum forming or some similar process. In this regard, the decorative indicia need not necessarily be confined to two-dimensional artwork applied to a smooth, continuous surface. If such three-dimensional decorative indicia is implemented, there must be sufficient clearance between the lower outer and inner sleeves 14, 16 and/or between the upper outer and inner sleeves 46, 54 to accommodate the same.

Referring now to FIGS. 13–16, there is depicted an animated display 200 constructed in accordance with a second embodiment of the present invention. The animated display 200 of the second embodiment is identical to the animated display 10 of the first embodiment in all respects, except that the collar 18 described above is not attached to the lower sleeve assembly 212 of the animated display 200. Thus, the upper outer sleeve 246 of the upper sleeve assembly 244 in the animated display 200 will only include a single decorative scene, and not potentially two different decorative scenes as described in relation to the upper outer sleeve 46 of the animated display 10 of the first embodiment.

Referring now to FIGS. 17–21, there is depicted an animated display 300 constructed in accordance with a third embodiment of the present invention. The animated display 300 of the third embodiment is substantially similar to the animated display 10 of the first embodiment, except that the upper inner sleeve 354 of the upper sleeve assembly 344 and the actuation assembly 356 of the animated display 300 are configured such that the upper inner sleeve 354 is rotatable relative to the upper outer sleeve 346 in either the same direction at a different speed or in an opposite direction. In the animated display 300, the upper inner sleeve 354 is formed to include a flange portion 348 similar to the flange portion 48 of the upper outer sleeve 46 described above. The flange portion 348 extends radially inward relative to the remainder of the upper inner sleeve 354. The inner peripheral edge of the flange portion 348 is formed to include gear teeth 350 similar to the gear teeth 50 formed on the flange portion 48 of the upper outer sleeve 46.

Figure 21:
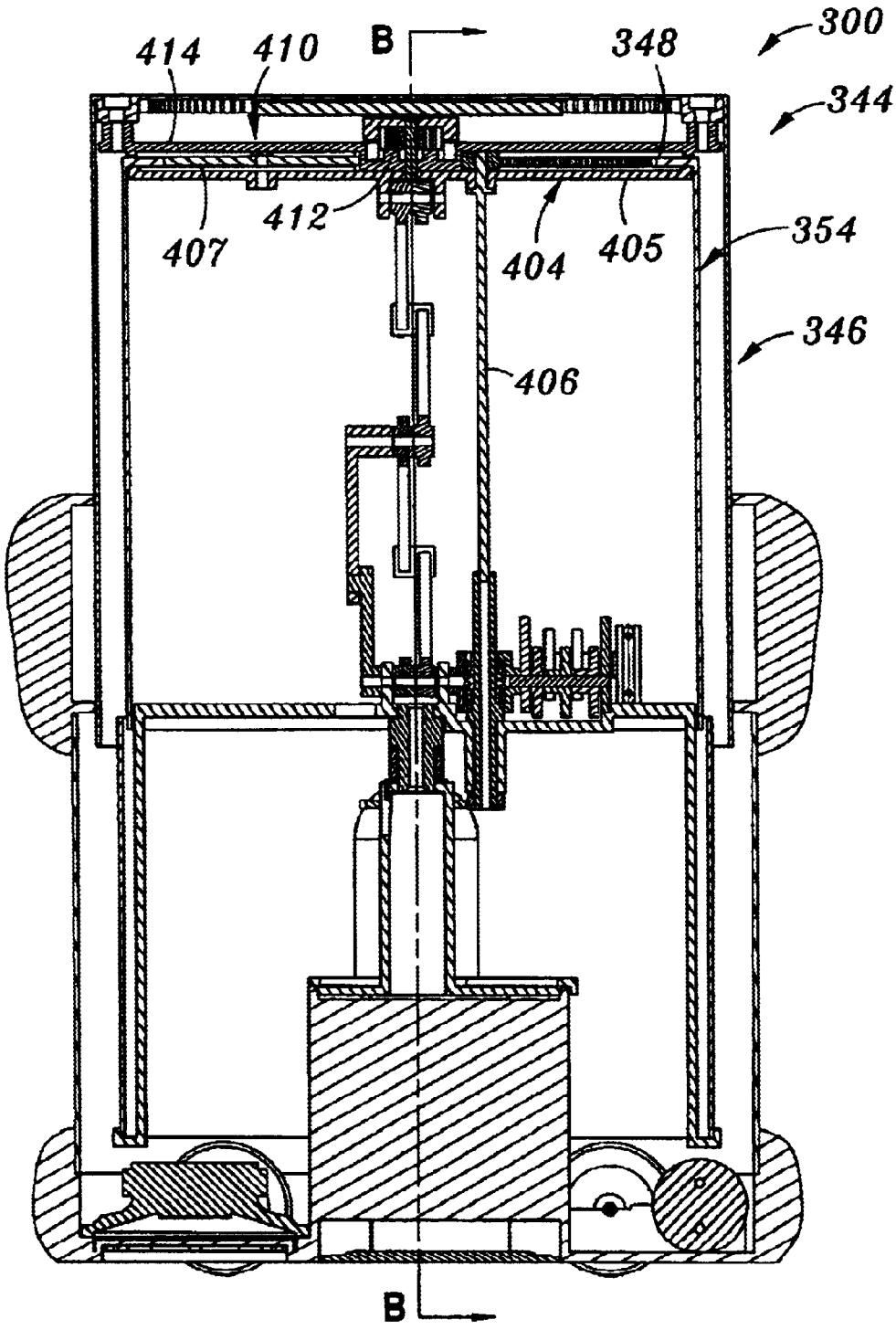
FIG. 21 is a cross-sectional view of the upper and lower telescoping sleeve assemblies and actuation assembly of the animated display of the third embodiment while in its extended configuration.
Figure 22:
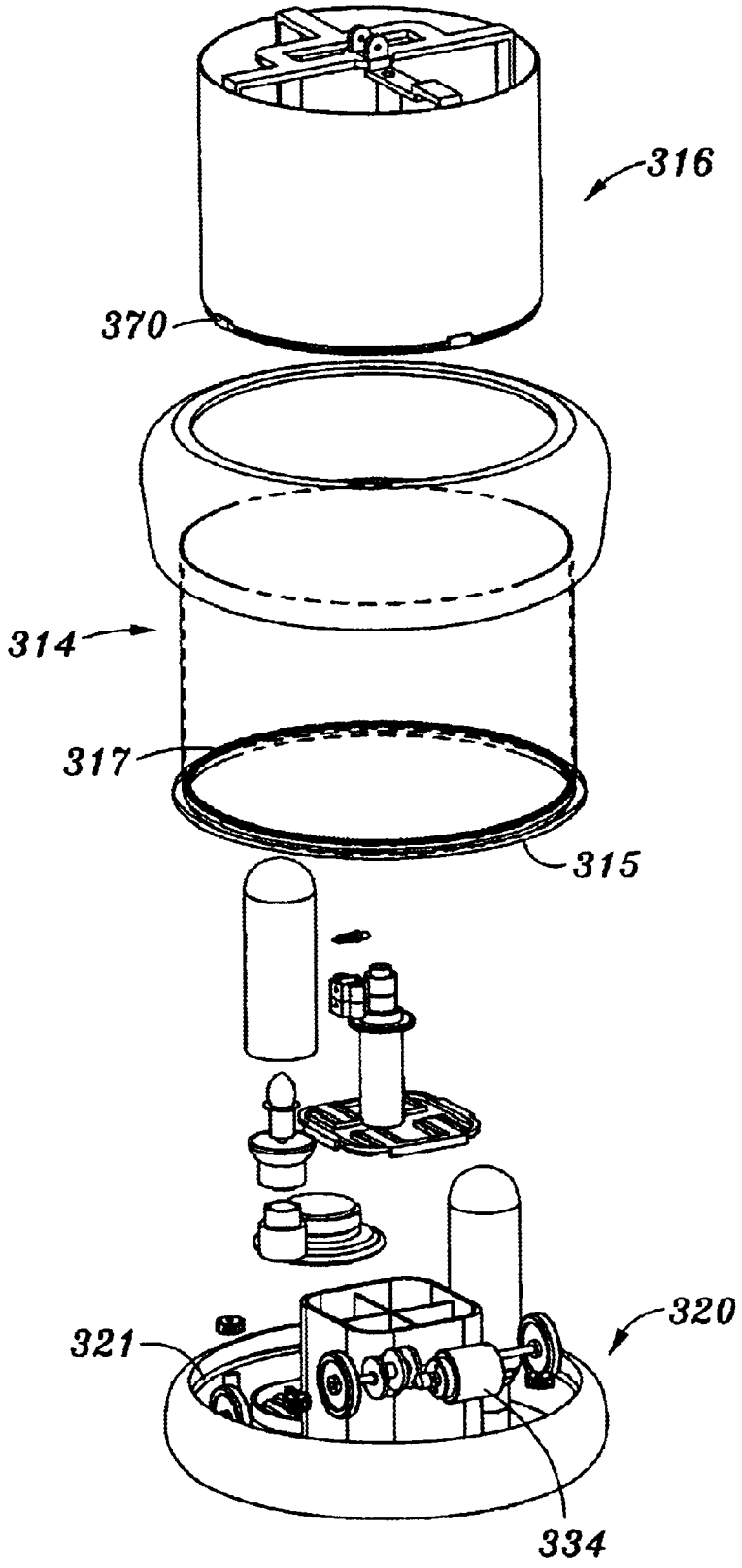
FIG. 22 is an exploded view of the lower sleeve assembly and support base of the animated display of the third embodiment, illustrating an arrangement providing for the rotation of the lower outer sleeve of the lower sleeve assembly.

The actuation assembly 356 of the animated display 300 differs from the actuation assembly 56 described above in that the support shelf 404 of the actuation assembly 356 (to which the top end of the drive rod 406 is rotatably connected) is generally cross-shaped. Thus, in the actuation assembly 356, both the support shelf 404 and the support strut 410 are generally cross-shaped, with the support shelf 404 defining four elongate arms 405 extending radially therefrom at intervals of approximately ninety degrees. As best seen in FIG. 21, the lengths of the arms 405 are substantially equal to the lengths of the arms 414 of the support strut 410 (which is identically configured to the support strut 110 of the actuation assembly 56).

Figure 18:
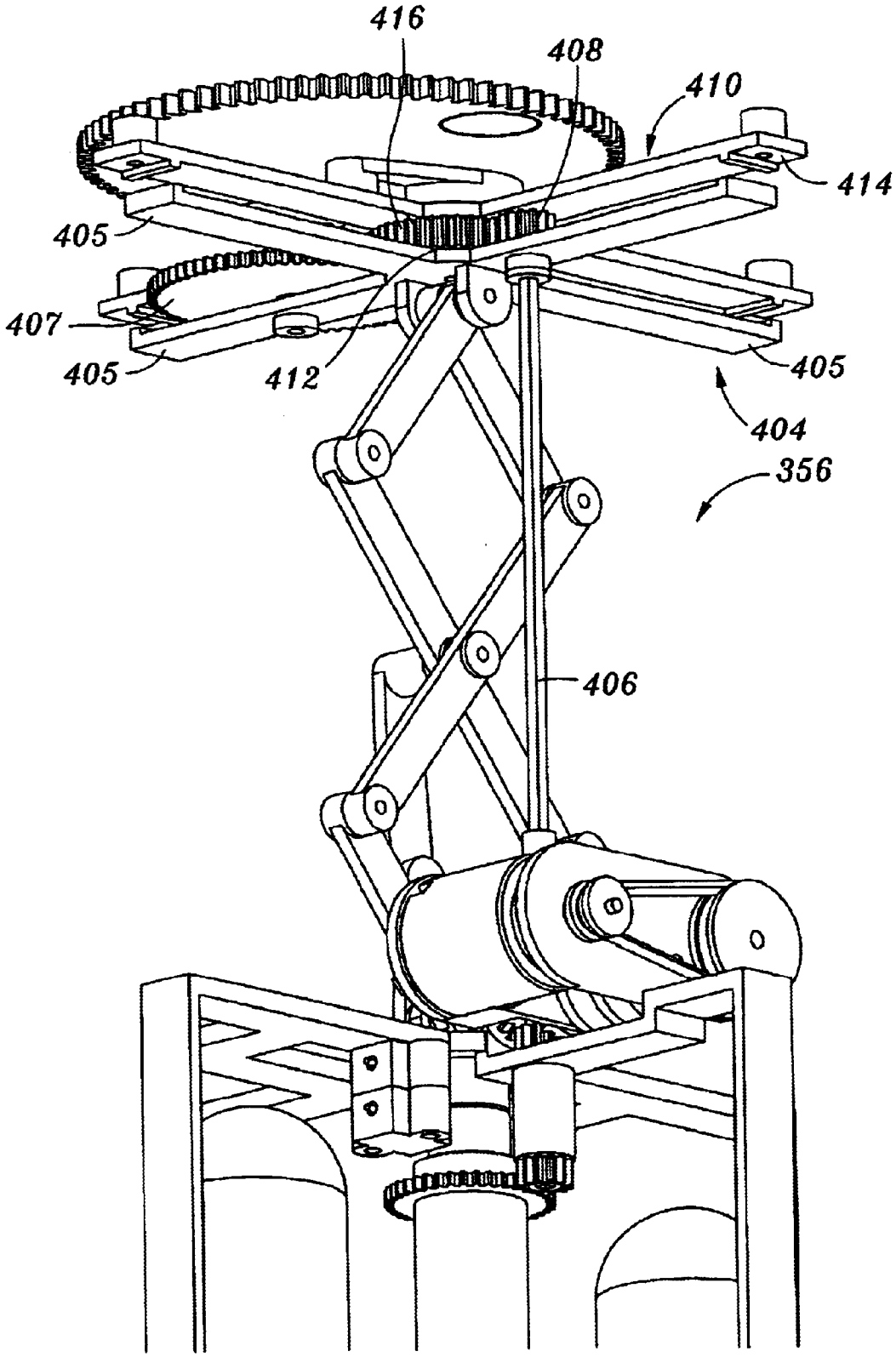
FIG. 18 is a partial, lower perspective view of the actuation assembly of the animated display of the third embodiment.
Figure 19:
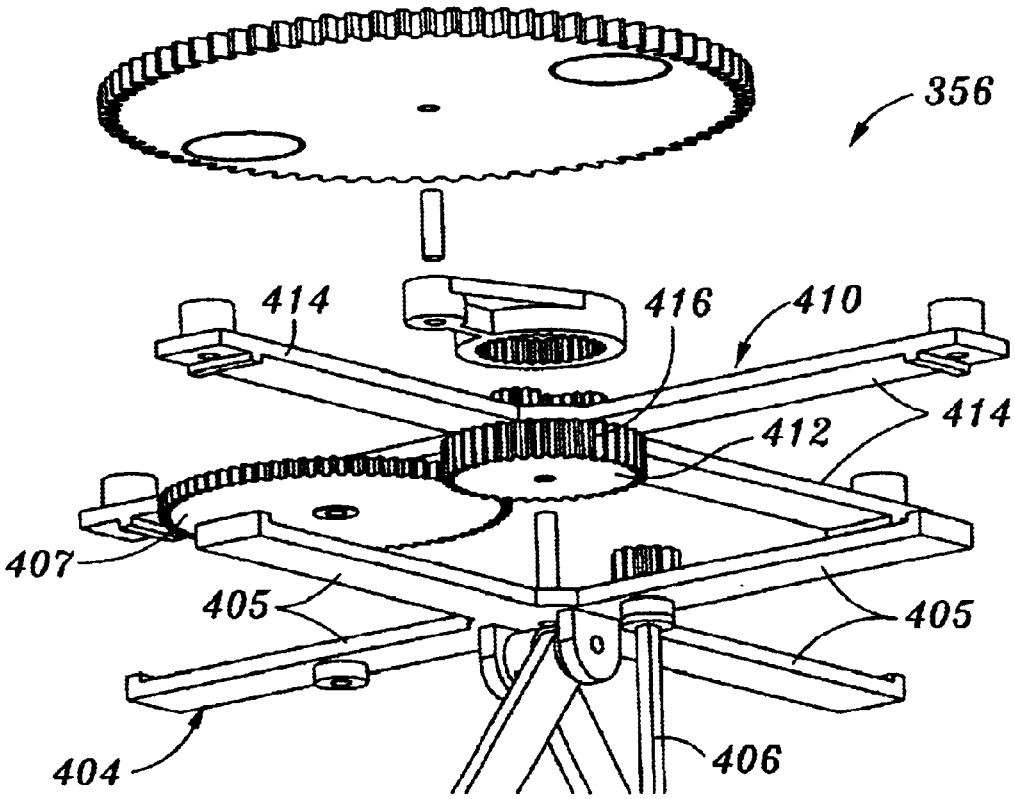
FIG. 19 is an exploded, lower perspective view of the upper portion of the actuation assembly shown in FIG. 18.
Figure 20:
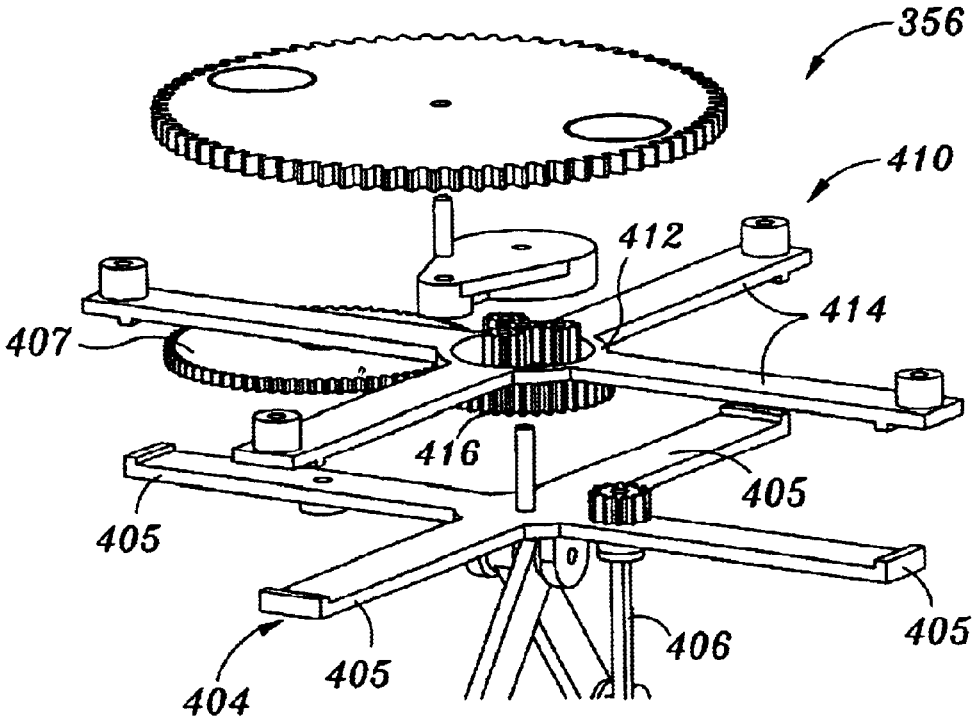
FIG. 20 is an exploded, upper perspective view of the upper portion of the actuation assembly shown in FIG. 18.

In the actuation assembly 356 of the animated display 300, rotatably connected to one of the arms 405 is a sleeve gear 407. The sleeve gear 407 is intermeshed with the gear teeth 416 formed on the outer surface of the central hub 412 of the support strut 410. As seen in FIGS. 18 and 21, when the actuation assembly 356 is fully assembled, a gap is defined between the arms 414 of the support strut 410 and the arms 405 of the support shelf 404, with such gap having a width substantially equal to the height of that portion of the central hub 412 defining the gear teeth 416. In assembling the animated display 300, the flange portion 348 of the upper inner sleeve 354 is slidably inserted into such gap. As such, as best seen in FIG. 21, the flange portion 348 is slidably captured between the protrusions formed on the undersides of the arms 414 in close proximity to the distal ends thereof, and the protrusions formed on and extending upwardly from the distal ends of the arms 405. The receipt of the flange portion 348 of the upper inner sleeve 354 between the arms 405, 414 facilitates the rotatable connection of the upper inner sleeve 354 to the actuation assembly 356. The sleeve gear 407, in addition to being intermeshed with the gear teeth 416 of the support strut 410, is also intermeshed with the gear teeth 350 formed on the inner peripheral edge of the flange portion 348 of the upper inner sleeve 354.

The intermesh of the sleeve gear 407 with the gear teeth 350, 416, coupled with the rotatable connection of the upper inner sleeve 354 to the actuation assembly 356, facilitates the rotation of the upper inner sleeve 354 in an opposite direction and at a rate of speed differing from that of the upper outer sleeve 346 which is itself rigidly attached to the support strut 410. It is contemplated that more than one sleeve gear 407 may be included in the actuation assembly 356 for facilitating the rotation of the upper inner sleeve 354 in the same direction as the upper outer sleeve 346 at a differing speed. It will be recognized that the animated display 200 of the second embodiment may be configured such that the upper outer sleeve 246 of the upper sleeve assembly 244 is rotatable at a different rate of speed and/or in an opposite direction than the upper inner sleeve 254 as previously described in relation to the animated display 300 of the third embodiment.

Referring now to FIGS. 22–25, it is contemplated that the actuation assembly 356, the lower outer sleeve 314 of the lower sleeve assembly 312 and the support base 320 of the animated display 300 may be alternatively configured in a manner wherein the lower outer sleeve 314 is itself rotatable in the same or opposite direction of the lower inner sleeve 316. To facilitate this functionality, attached to the bottom ends of the arms 368 of the support frame 366 below the support tabs 370 is an annular gear ring 442. Formed on the outer peripheral edge of the gear ring 442 are gear teeth 444. The support tabs 370 of the support frame 366 of the actuation assembly 356 are disposed above the gear teeth 444.

Figure 23:
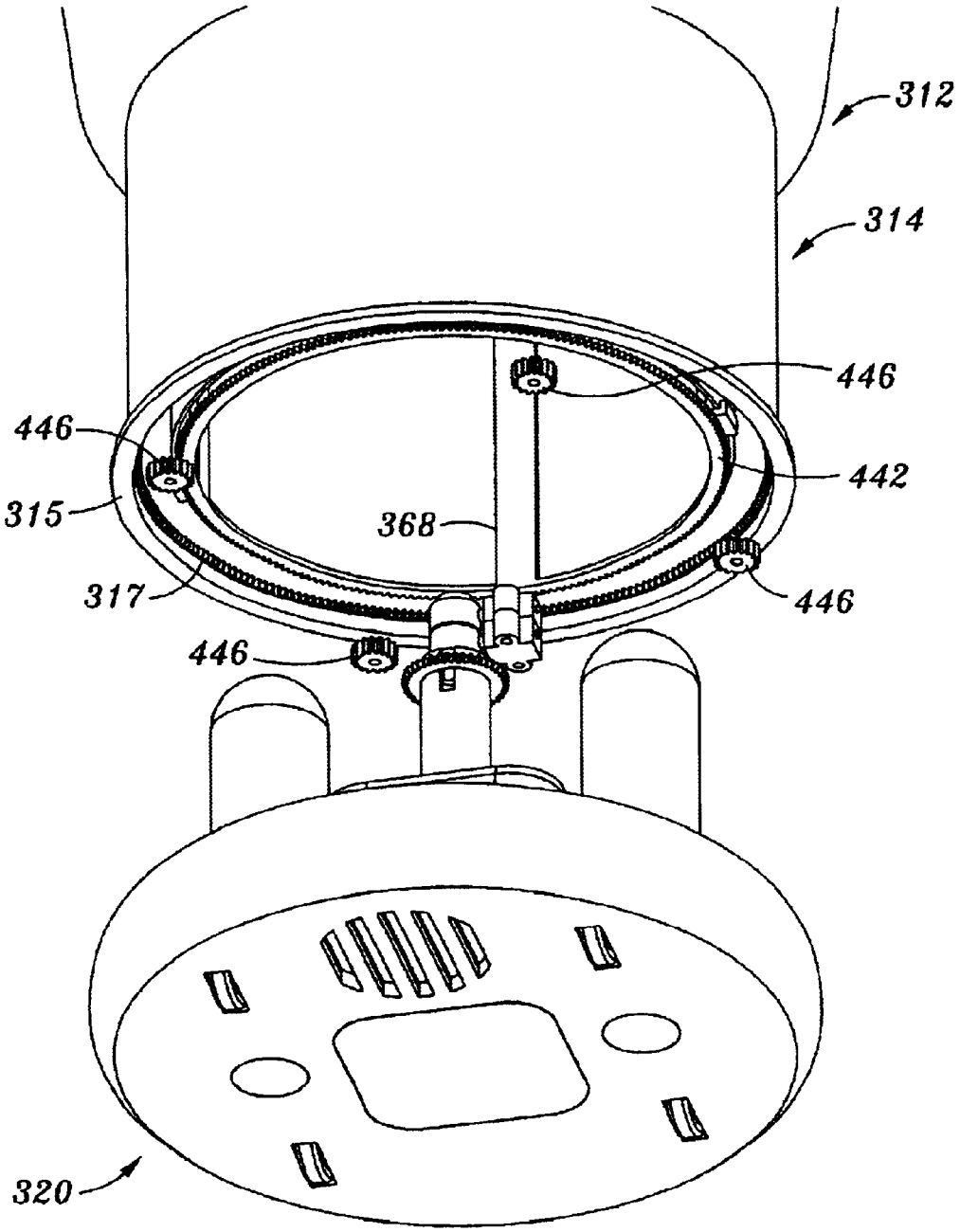
FIG. 23 is an exploded view of the lower sleeve assembly and support base of the rotating lower outer sleeve arrangement.
Figure 24:
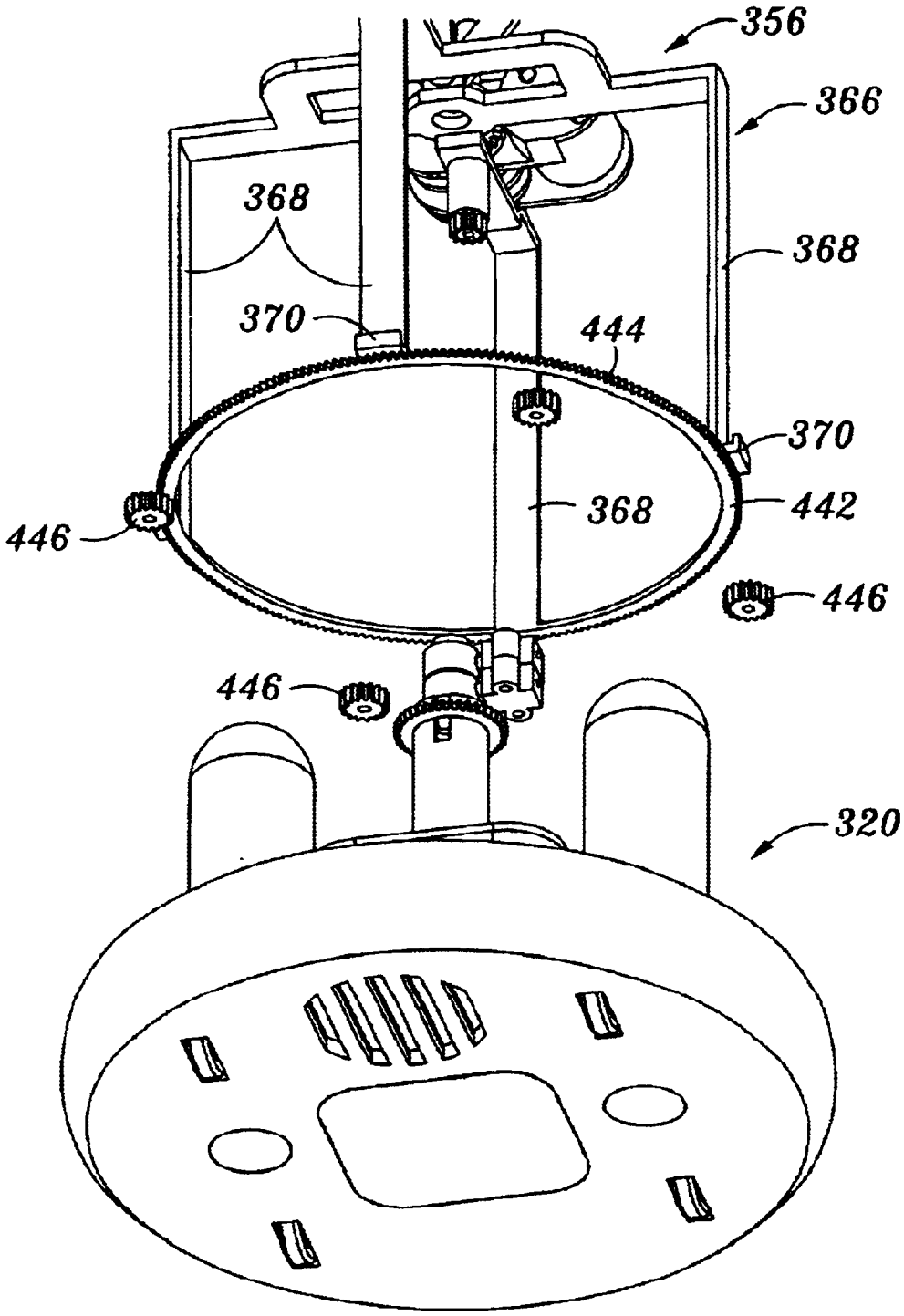
FIG. 24 is an exploded view of the actuation assembly and support base of the rotating lower outer sleeve arrangement.
Figure 25:
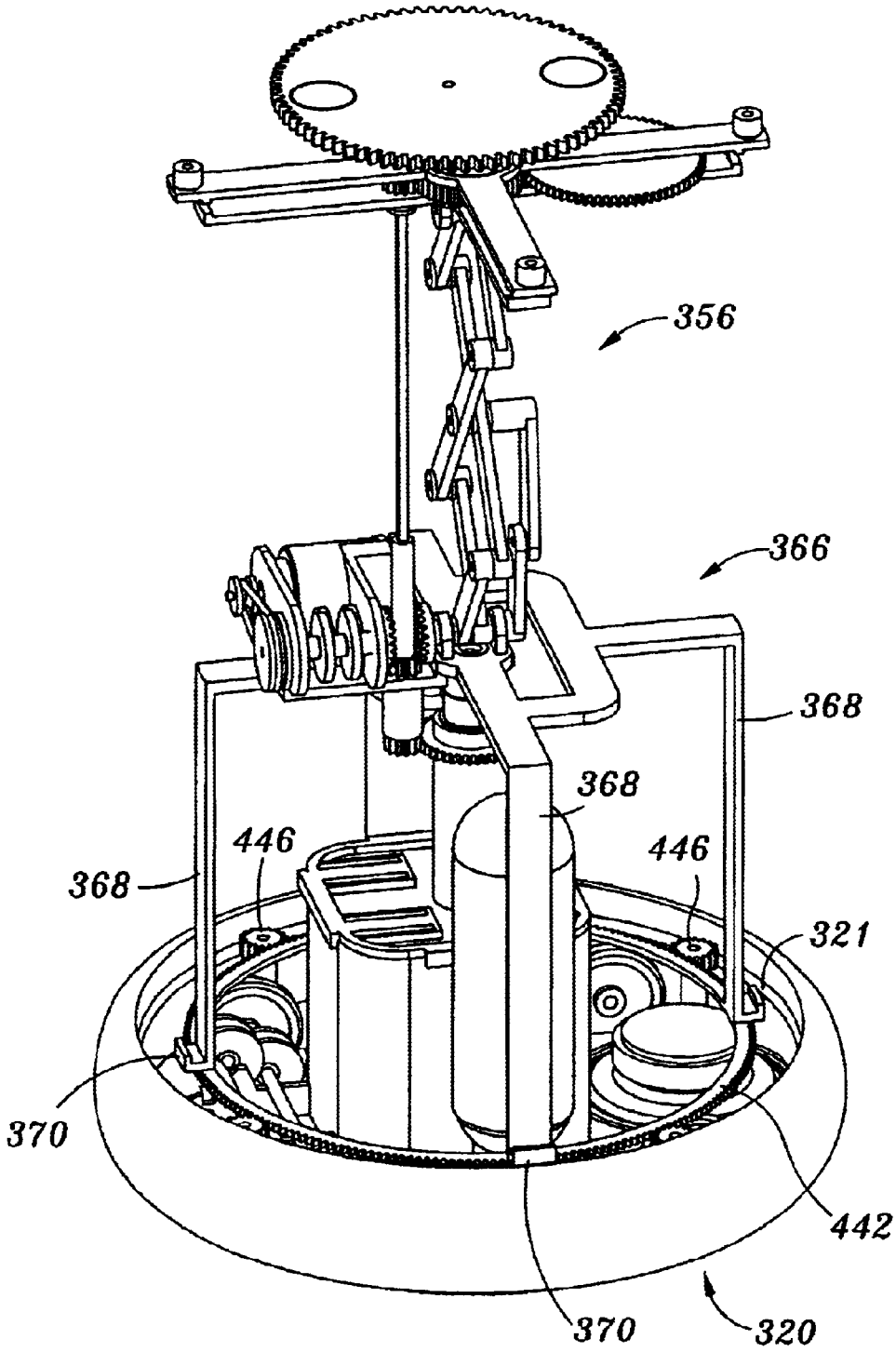
FIG. 25 is a perspective view of the actuation assembly and support base of the rotating lower outer sleeve arrangement.
Figure 26:
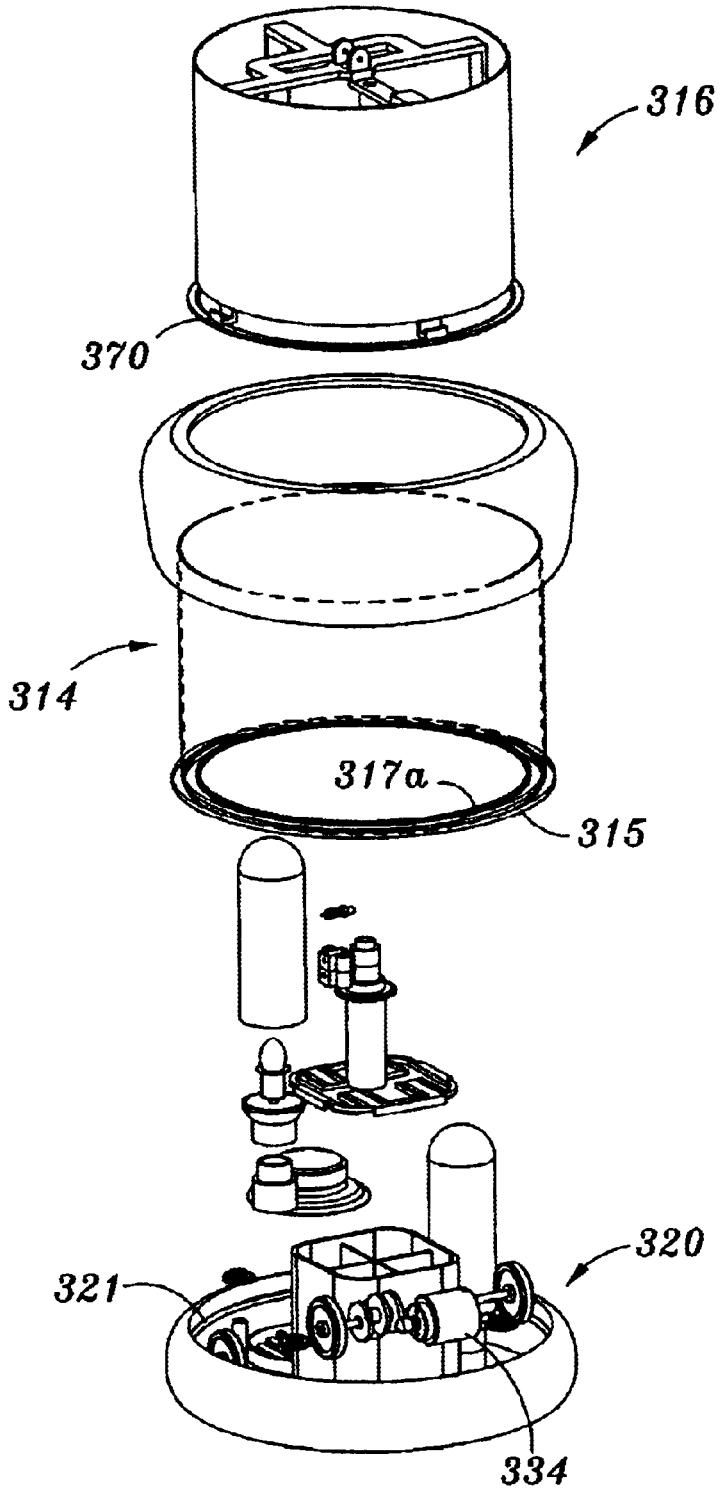
FIG. 26 is an exploded view of the lower sleeve assembly and support base of the animated display of the third embodiment, illustrating an alternative arrangement providing for the rotation of the lower outer sleeve of the lower sleeve assembly.

Formed on the bottom end of the lower outer sleeve 314 is a continuous flange portion 315 which extends radially outward relative to the remainder of the lower outer sleeve 314. The flange portion 315 is slidably receivable into a complementary, continuous channel 321 formed in the inner surface of the annular peripheral wall of the support base 320. The receipt of the flange portion 315 into the channel 321 facilitates the rotatable connection of the lower outer sleeve 314 to the support base 320. Additionally, formed on the inner surface of the lower outer sleeve 314 adjacent the flange portion 315 are gear teeth 317. When the lower sleeve assembly 312 is assembled, the gear teeth 317 are aligned with but spaced radially from the gear teeth 444 of the gear ring 442. Disposed within the gap defined between the gear teeth 444, 317 are a plurality (e.g., four) gears 446. As best seen in FIG. 23, the gears 446 are separated from each other by intervals of approximately ninety degrees, and are each intermeshed between the gear teeth 444 of the gear ring 442 and the gear teeth 317 of the lower outer sleeve 314.

In the animated display 300 including the rotatable lower outer sleeve 314, the lower inner sleeve 316 is cooperatively engaged to and carried by the support frame 366 in essentially the same manner previously described in relation to the animated display 10 of the first embodiment. The bottom end or rim of the lower inner sleeve 316 is rested upon the top surface of the gear ring 442 and retained thereon by the support tabs 370. The lower inner sleeve 316 rotates with the support frame 366 since it is carried thereby. The intermesh between the gears 446 and the gear, teeth 444, 317, coupled with the rotatable connection of the lower outer sleeve 314 to the support base 320 (attributable to the receipt of the flange portion 315 into the channel 321) facilitates the rotation of the lower outer sleeve 314 as a result of the rotation of the support frame 366.

In the animated display 300 including the rotatable lower outer sleeve 314 as shown in FIGS. 22–25, the lower outer sleeve 314 rotates in a direction opposite the lower inner sleeve 316. Additionally, the lower inner sleeve 316 rotates at a faster speed than that of the lower outer sleeve 314 attributable to the diameter of the gear ring 442 being smaller than that of the gear teeth 317 formed within the lower outer sleeve 314.

Referring now to FIGS. 26–29, it is further contemplated that the lower outer sleeve 314 may be caused to rotate in the same direction of the support frame 366 at a different rotational speed. In this regard, in such arrangement, an annular gear ring 442*a* is attached to the bottom ends of the arms 368 of the support frame 366 below the support tabs 370 thereof. In the gear ring 442*a*, the gear teeth 444*a* are formed on the inner peripheral edge thereof, as opposed to the outer peripheral edge as is the case in the above-described gear ring 442. The lower outer sleeve 314 includes the flange portion 315 which extends radially outward relative to the remainder of the lower outer sleeve 314. The flange portion 315 is slidably receivable into a complementary, continuous channel 321 formed on the inner surface of the annular peripheral wall of the support base 320. The receipt of the flange portion 315 into the channel 321 facilitates the rotatable connection of the lower outer sleeve 314 to the support base 320.

Figure 27:
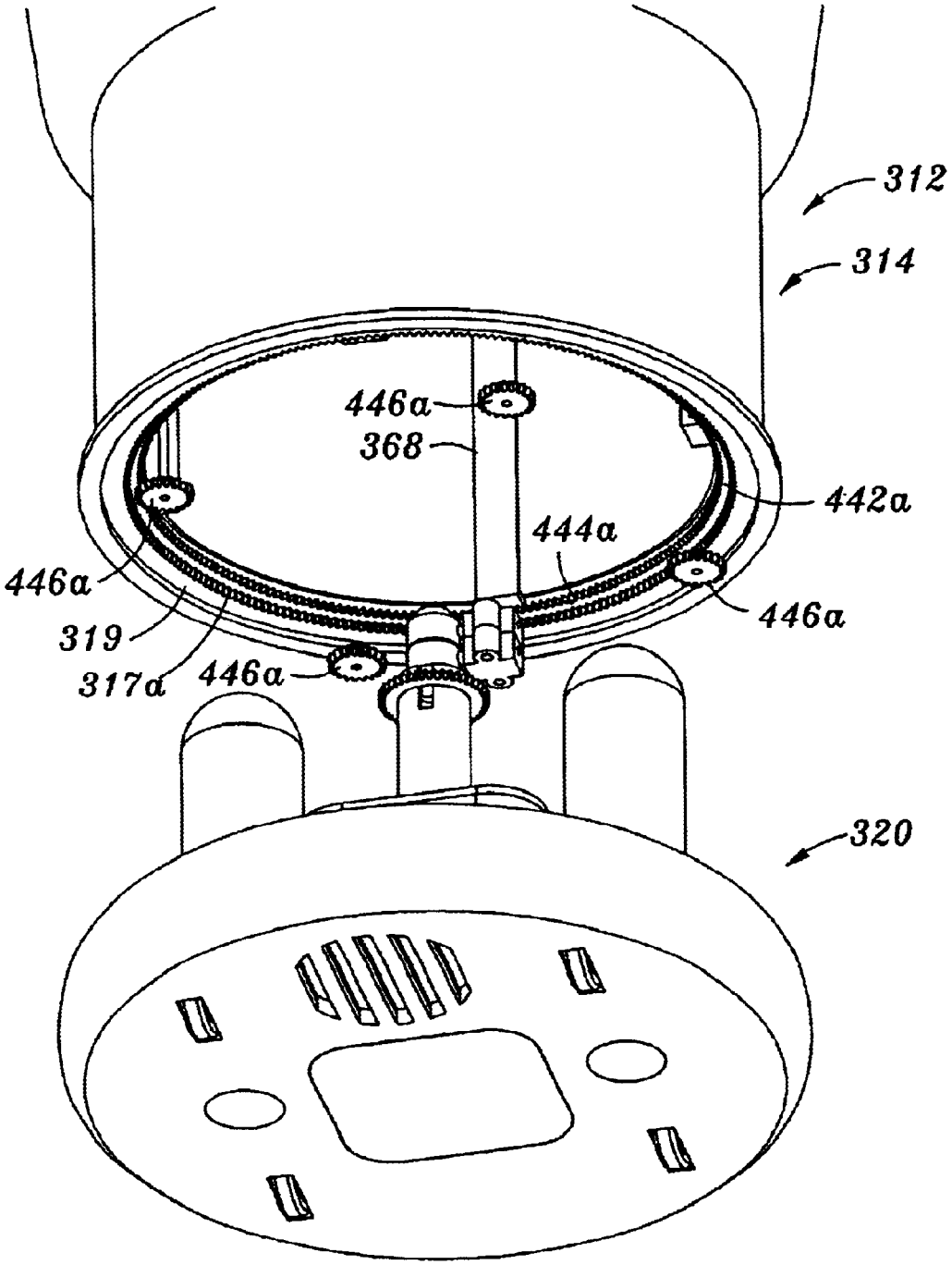
FIG. 27 is an exploded view of the lower sleeve assembly and support base of the alternative rotating lower outer sleeve arrangement.
Figure 28:
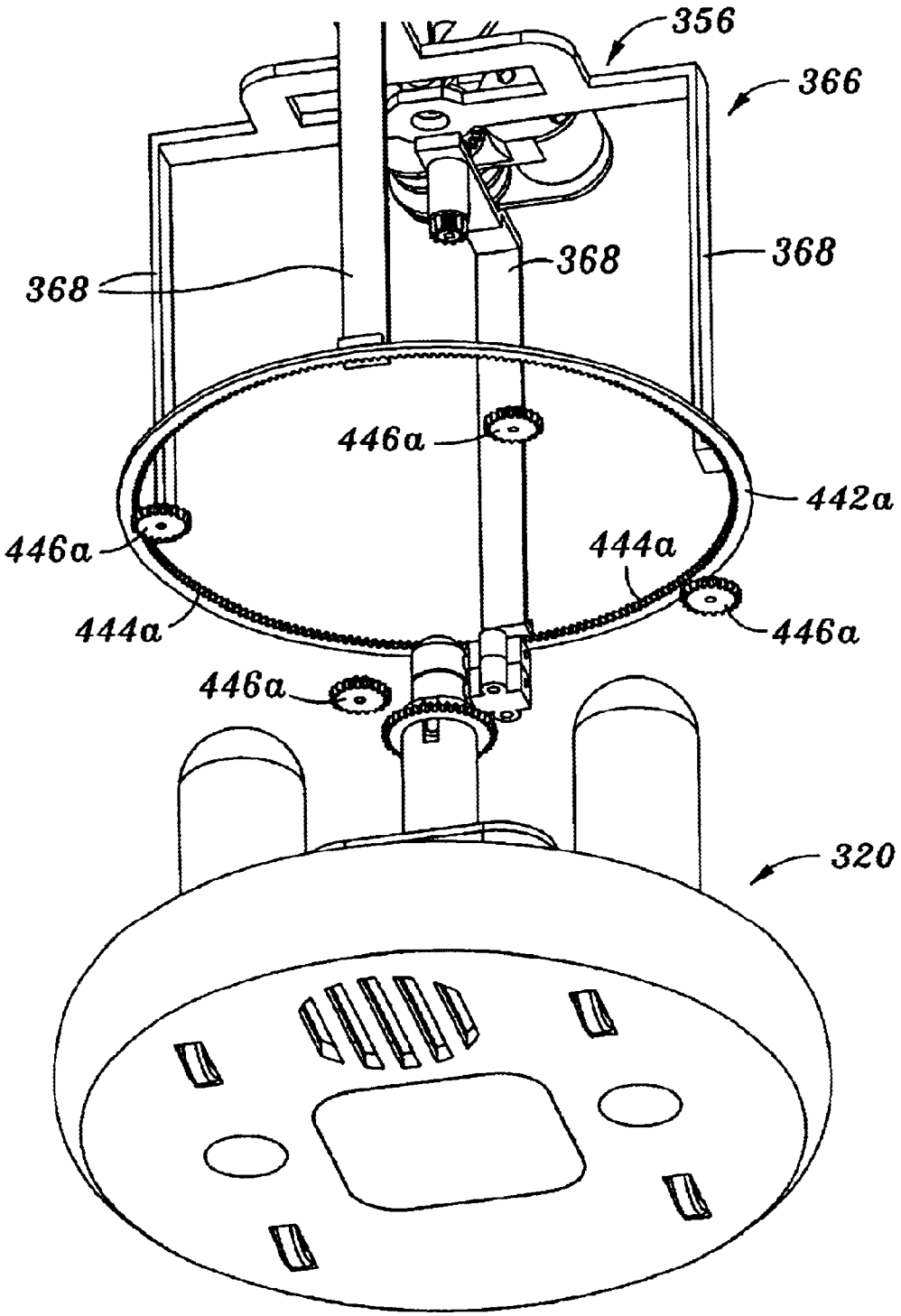
FIG. 28 is an exploded view of the actuation assembly and support base of the alternative rotating lower outer sleeve arrangement.

Formed on the inner surface of the lower outer sleeve 314 in close proximity to the flange portion 315 is another flange portion 319 which extends radially inward relative to the remainder of the lower outer sleeve 314. Formed on the inner peripheral edge of the flange portion 319 are gear teeth 317*a*. Thus, in contrast to the gear teeth 317 described above which are formed directly within the inner surface of the lower outer sleeve 314 adjacent the flange portion 315, the gear teeth 317*a* are formed on the inner peripheral edge of the flange portion 319. As best seen in FIG. 27, when the lower sleeve assembly 312 is assembled, the gear teeth 317*a* are disposed below and spaced radially outward relative to the gear teeth 444*a* of the gear ring 442*a*.

Figure 29:
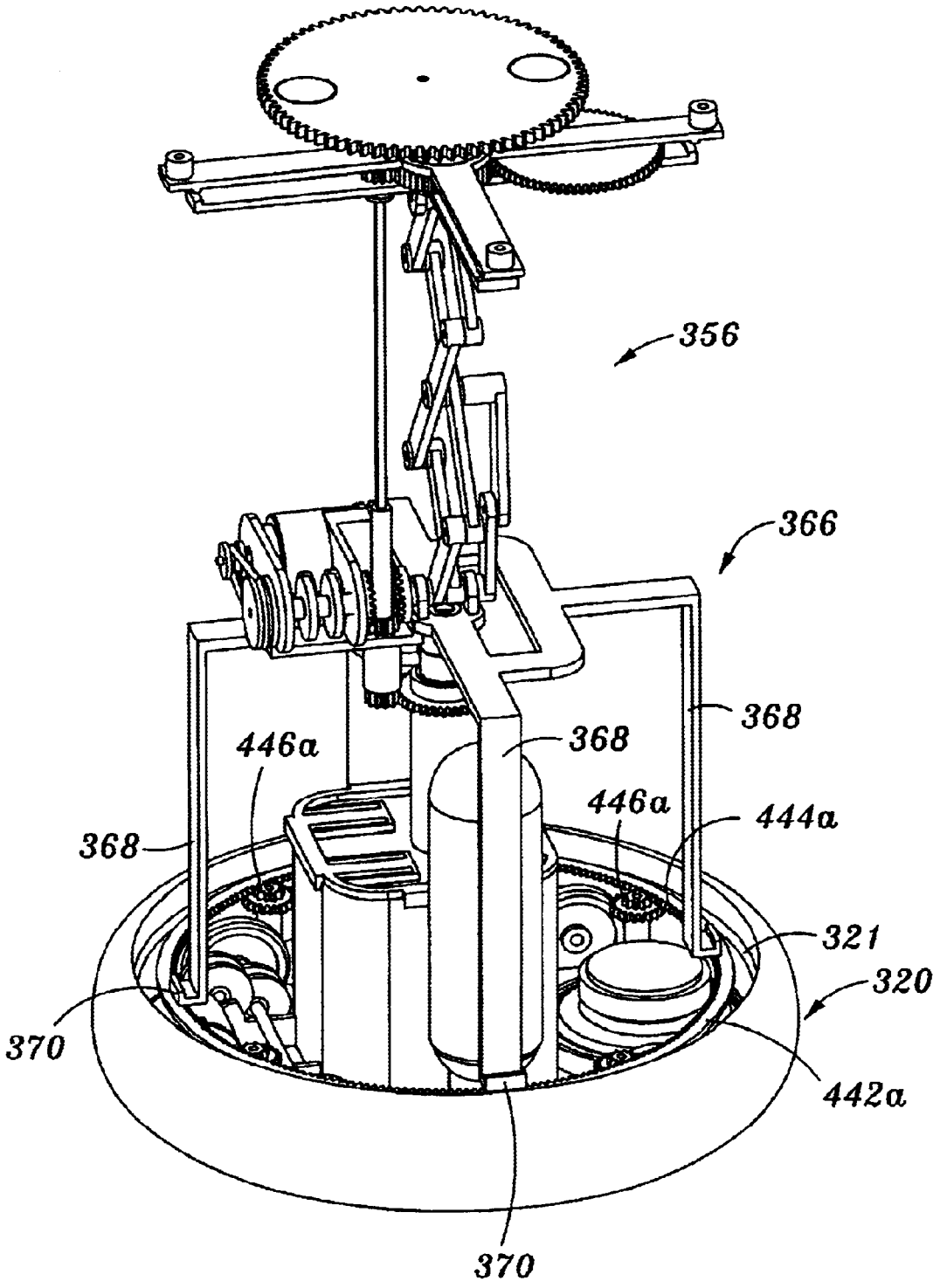
FIG. 29 is a perspective view of the actuation assembly and support base of the alternative rotating lower outer sleeve arrangement.

As best seen in FIG. 29, intermeshed to the gear teeth 444*a*, 317*a* are a plurality (e.g., four) gear stacks 446*a*. The gear stacks 446*a* are separated from each other by intervals of approximately ninety degrees and, as indicated above, are each intermeshed to the gear teeth 444*a* of the ring gear 442*a* and the gear teeth 317*a* of the lower outer sleeve 314. As further seen in FIG. 29, the lowermost gear of each gear stack 446*a* has a diameter exceeding that of the corresponding upper gear.

In the animated display 300 including this alternative arrangement, the lower inner sleeve 316 is cooperatively engaged to and carried by the support frame 366 in the same manner previously described in relation to the animated display 10 of the first embodiment. The bottom end or rim of the lower inner sleeve 316 is rested upon the top surface of the gear ring 442*a* and retained thereon by the support tabs 370. The lower inner sleeve 316 rotates with the support frame 366 since it is carried thereby. The intermesh between the gear stacks 446*a* and the gear teeth 444*a*, 317*a* facilitates the rotation of the lower outer sleeve 314 in the same direction of the lower inner sleeve 316. The lower outer sleeve 314 rotates at a faster speed than that of the lower inner sleeve 316 due to the diameter of the lower gear in each gear stack 446*a* which intermeshes with the gear teeth 317*a* being larger than the diameter of the upper gear of each gear stack 446*a* which intermeshes with the gear teeth 444*a* of the gear ring 442*a*. If the gear stacks 446*a* were to be turned upside down and the flange portion 319 enlarged such that the gear teeth 317*a* extend radially inward relative to the gear teeth 444*a*, the lower inner sleeve 316 will rotate faster than the lower outer sleeve 314 due to the intermesh between the smaller diameter lower gear of each gear stack 446*a* with the gear teeth 317*a* and the intermesh of the larger diameter upper gear of each gear stack 446*a* with the gear teeth 444*a* of the gear ring 442*a*.

Those of ordinary skill in the art will recognize that the arrangements which facilitate the independent rotation of the lower outer sleeve 314 are also applicable to the animated displays 100, 200 of the first and second embodiments of the present invention. Additionally, though not shown, it is contemplated that alternative arrangements may be employed to facilitate the rotation of the lower outer sleeve 314 relative to the support base 320 such as, for example, the interface of the drive motor 334 to the lower outer sleeve 314 via a gear train.

Referring once again to FIG. 11, in the animated display 10 of the first embodiment, the intermesh between the gear 108 attached to the top end of the drive rod 106 and the gear teeth 116 formed on the central hub 112 of the support strut 110 facilitates the rotation of the upper sleeve assembly 44 (i.e., the upper outer and inner sleeves 46, 54) in a direction opposite the rotational direction of the lower inner sleeve 16 which is cooperatively engaged to the support frame 66 of the actuation assembly 56. Though not shown, it is contemplated that the actuation assembly 56 may alternatively be configured such that an additional gear is intermeshed between the gear 108 and the gear teeth 116 of the central hub 112. This additional gear would facilitate the rotation of the upper sleeve assembly 44 in the same direction as that of the lower inner sleeve 16 of the lower sleeve assembly 12. Referring now to FIG. 18, along the same lines, an additional gear could be intermeshed between the sleeve gear 407 and the gear teeth 416 formed on the central hub 412 of the support strut 410. In the actuation assembly 356 shown in FIG. 18, the upper outer sleeve 346 and upper inner sleeve 354 of the upper sleeve assembly. 344 rotate in opposite directions. The intermesh of the additional gear between the sleeve gear 407 and the gear teeth 416 of the central hub 412 would facilitate the rotation of the upper outer and inner sleeves 346, 354 in the same direction at different speeds.

Additional modifications and improvements of the present invention may also be apparent to those of ordinary skill in the art. For example, it is contemplated that the upper inner sleeve 54 of the upper sleeve assembly 44 can be deleted to provide an animated display of more simple construction for less cost. In such embodiment, the upper outer sleeve 46 of the upper sleeve assembly 44 would preferably be translucent, having a decorative scene provided thereon. Similarly, the lower outer sleeve 14 of the lower sleeve assembly 12 could be deleted to also provide an animated display of more simple construction for less cost. It is also contemplated that any one of the upper inner and outer sleeves and lower inner and outer sleeves may be constructed from one annular frame (a top frame) or two annular frames (top and bottom frames) which include a flexible material hanging therefrom (in the case of one frame) or a flexible material extending therebetween (in the case of two frames). Additionally, though an exemplary embodiment of the actuation assembly is described herein, those of ordinary skill in the art will recognize that other actuation assemblies of like functionality may be included in the animated display of any embodiment of the present invention. Thus, the particular combination of parts described and illustrated herein is intended to represent only certain embodiments of the present invention, and is not intended to serve as limitations of alternative devices within the spirit and scope of the invention.

What is claimed is:

1. An animated device comprising:

a lower sleeve assembly including:

a lower outer sleeve; and a lower inner sleeve positioned within the lower outer sleeve;

an upper sleeve assembly including:

an upper outer sleeve; and an upper inner sleeve positioned within the upper outer sleeve;

the upper sleeve assembly being selectively retractable into and extensible from the lower sleeve assembly in a telescoping fashion; and an actuation assembly cooperatively engaged to the lower and upper sleeve assemblies and operative to facilitate the rotation of the lower inner sleeve relative to the lower outer sleeve, the rotation of the upper outer and inner sleeves relative to the lower sleeve assembly, the retraction of the upper sleeve assembly into the lower sleeve assembly, and the extension of the upper sleeve assembly from the lower sleeve assembly.

2. The animated device of claim 1 wherein:

the animated device further comprises a support base;

the lower outer sleeve of the lower sleeve assembly is rotatably connected to the support base; and the actuation assembly is operative to facilitate the rotation of the lower outer sleeve relative to the support base.

3. The animated device of claim 2 wherein the actuation assembly is operative to facilitate the rotation of the upper outer and inner sleeves in opposite directions relative to each other.

4. The animated device of claim 2 wherein the actuation assembly is operative to facilitate the rotation of the lower outer and inner sleeves of the lower sleeve assembly in opposite directions relative to each other.

5. The animated device of claim 1 wherein the actuation assembly is operative to simultaneously facilitate the rotation of the lower inner sleeve relative to the lower outer sleeve, the rotation of the upper outer and inner sleeves relative to the lower sleeve assembly, and one of the retraction of the upper sleeve assembly into the lower sleeve assembly and the extension of the upper sleeve assembly from the lower sleeve assembly.

6. An animated device comprising:

a lower sleeve assembly including:

a lower outer sleeve fabricated from a transparent material having decorative indicia thereon; and a lower inner sleeve positioned within the lower outer sleeve and fabricated from a translucent material having decorative indicia thereon; an upper sleeve assembly including:

the upper outer sleeve fabricated from a transparent material having decorative indicia thereon; and an upper inner sleeve positioned within the upper outer sleeve and fabricated from a translucent material having decorative indicia thereon;

the upper sleeve assembly being selectively retractable into and extensible from the lower sleeve assembly in a telescoping fashion; and an actuation assembly cooperatively engaged to the lower and upper sleeve assemblies and operative to facilitate the rotation of the lower inner sleeve relative to the lower outer sleeve, the rotation of the upper outer and inner sleeves relative to the lower sleeve assembly, the retraction of the upper sleeve assembly into the lower sleeve assembly, and the extension of the upper sleeve assembly from the lower sleeve assembly.

7. The animated device of claim 1 wherein the upper outer sleeve is advanced between the lower outer and inner sleeves when the upper sleeve assembly is retracted into the lower sleeve assembly.

8. The animated device of claim 1 wherein the actuation assembly is operative to facilitate the rotation of the upper inner sleeve relative to the upper outer sleeve.

9. An animated device comprising:

a lower sleeve assembly including:

a lower outer sleeve; and a lower inner sleeve positioned within the lower outer sleeve;

at least one upper sleeve selectively retractable into and extensible from the lower sleeve assembly in a telescoping fashion; and an actuation assembly cooperatively engaged to the lower sleeve assembly and the upper sleeve, the actuation assembly being operative to facilitate the rotation of the lower inner sleeve relative to the lower outer sleeve, the rotation of the upper sleeve relative to the lower sleeve assembly, the retraction of the upper sleeve into the lower sleeve assembly, and the extension of the upper sleeve from the lower sleeve assembly.

10. An animated device comprising:

at least one lower sleeve;

an upper sleeve assembly including:

an upper outer sleeve; and an upper inner sleeve positioned within the upper outer sleeve;

the upper sleeve assembly being selectively advanceable into and extensible from the lower sleeve in a telescoping fashion; and an actuation assembly cooperatively engaged to the lower sleeve and the upper sleeve assembly, the actuation assembly being operative to facilitate the rotation of the lower sleeve, the rotation of the upper sleeve assembly relative to the lower sleeve, the advancement of the upper sleeve assembly into the lower sleeve, and the extraction of the upper sleeve assembly from the lower sleeve.

11. An animated device comprising:

at least one lower sleeve;

at least one upper sleeve selectively movable between a retracted position and an extended position relative to the lower sleeve in a telescoping fashion; and an actuation assembly cooperatively engaged to the lower and upper sleeves, the actuator assembly being operative to facilitate the rotation of the upper sleeve relative to the lower sleeve, and the movement of the upper sleeve between the retracted and extended positions.

* * * * *